US010808486B2

(12) United States Patent
Angers, Jr.

(10) Patent No.: US 10,808,486 B2
(45) **Date of Patent: *Oct. 20, 2020**

(54) SIDE DOOR HANGER SYSTEM FOR SEALING A PASS-THROUGH IN A WELLHEAD, AND METHOD THEREFORE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 247 days.

This patent is subject to a terminal disclaimer.

(21) Appl. No.: 15/608,783

(22) Filed: May 30, 2017

(65) Prior Publication Data

US 2018/0347303 A1 Dec. 6, 2018

(51) Int. Cl.

| | |
|---|---|
| ***E21B 33/04*** | (2006.01) |
| ***E21B 33/047*** | (2006.01) |
| ***E21B 33/037*** | (2006.01) |
| ***E21B 23/01*** | (2006.01) |
| *E21B 23/02* | (2006.01) |

(52) U.S. Cl.

CPC ..... *E21B 33/0407* (2013.01); *E21B 23/01* (2013.01); *E21B 33/037* (2013.01); *E21B 33/047* (2013.01); *E21B 33/0415* (2013.01); *E21B 23/02* (2013.01)

(58) Field of Classification Search

CPC .... E21B 33/0407; E21B 23/01; E21B 33/037; E21B 33/0415; E21B 33/047; E21B 23/02

See application file for complete search history.

(56) References Cited

U.S. PATENT DOCUMENTS

| | | | | |
|---|---|---|---|---|
| 3,781,456 | A | 12/1973 | Knowles et al. | |
| 4,388,971 | A * | 6/1983 | Peterson | E21B 23/02 166/124 |
| 4,583,804 | A | 4/1986 | Thompson | |
| 5,148,864 | A | 9/1992 | Willis et al. | |
| 5,289,882 | A | 3/1994 | Moore | |
| 5,332,043 | A * | 7/1994 | Ferguson | E21B 33/0422 166/379 |
| 6,234,252 | B1 * | 5/2001 | Pallini, Jr. | E21B 33/038 166/345 |

(Continued)

FOREIGN PATENT DOCUMENTS

WO WO 2015/034694 A2 3/2015

*Primary Examiner* — Yong-Suk Ro

(74) *Attorney, Agent, or Firm* — Joseph T Regard, Ltd plc

(57) ABSTRACT

A hanger system for providing sealed passage for cables, lines, tubes or the like through a wellhead is provided. The hanger has a main seal formed to receive and provide sealed pass-through of power and control cables, lines, conduits, or other threaded components therethrough, while effectively packing off and sealing the well bore. The hanger is provided with hinged side doors formed to engage and support the components. When the hanger with threaded components is positioned to rest in the bowl of the tubing head, the lower string weight is utilized to compress the main seal, providing an effective seal. The present system is suitable for use with permanent as well as temporary applications, and is designed to provide a low to medium pressure seal. Also taught is a bowl cap with compression seal to cover the present system, while providing enhanced, sealed pass-through.

38 Claims, 27 Drawing Sheets

(56) References Cited

U.S. PATENT DOCUMENTS

| | | | | |
|---|---|---|---|---|
| 6,332,499 | B1 | 12/2001 | Kobylinski et al. | |
| 6,530,433 | B2 | 3/2003 | Smith et al. | |
| 6,688,386 | B2 | 2/2004 | Cornelssen et al. | |
| 7,162,933 | B2 | 1/2007 | Thompson et al. | |
| 7,232,347 | B1 | 6/2007 | Moore | |
| 7,405,358 | B2 | 7/2008 | Emerson | |
| 7,798,208 | B2 * | 9/2010 | Purkis | E21B 33/04 166/75.14 |
| 8,297,345 | B2 | 10/2012 | Emerson | |
| 8,485,262 | B1 * | 7/2013 | Angers | E21B 33/043 166/339 |
| 9,316,062 | B2 | 4/2016 | Emerson et al. | |
| 2004/0231835 | A1 | 11/2004 | Thai et al. | |
| 2008/0026623 | A1 | 1/2008 | Emerson | |
| 2008/0110644 | A1 | 5/2008 | Howell et al. | |
| 2008/0230233 | A1 * | 9/2008 | Fay | E21B 23/01 166/382 |
| 2013/0277067 | A1 | 10/2013 | Emerson et al. | |
| 2014/0151069 | A1 * | 6/2014 | Kajaria | E21B 33/047 166/382 |
| 2017/0211339 | A1 | 7/2017 | Emerson et al. | |

* cited by examiner

64"
94
57
51
93
94'

SIDE DOOR HANGER SYSTEM FOR SEALING A PASS-THROUGH IN A WELLHEAD, AND METHOD THEREFORE

FIELD OF THE INVENTION

The present invention relates to wellheads, and in particular to a hanger system to seal a wellhead on a temporary or long-term basis, while providing sealed passage therethrough for cables, lines, tubes or the like therethrough.

GENERAL BACKGROUND DISCUSSION OF THE INVENTION

Electrical Submersible Pumps (ESP) are increasingly used in petroleum wells, providing a reliable and efficient means of lifting fluid from the wellbore. Unlike the old "pumpjack" reciprocating piston oil pumps, ESP's can be quickly and easily implemented in a well. The need for a reliable, safe, and relatively easily implemented system to temporarily hang an ESP during installation on a temporary as well as permanent basis has been a long felt, but unresolved need in the industry.

ESP's, along with numerous other downhole devices/applications, require a power cable running through the wellhead to be operative. To allow these devices to operate unattended and be in compliance with regulatory requirements, the wellhead must be sealed. Prior systems have attempted a temporary as well as permanent sealed pass-through for power, capillary and other types of cables and lines, but they are believed for the most part to be ineffective, generally requiring repeated cutting and splicing when sealing off the well. Accordingly, there exists a need to seal the ESP power cable(s) and other components including lines, conduits, tubes and the like temporarily as well as permanently in the wellhead for unattended operation, allowing the passage therethrough of power and control lines and the like without the need for cutting and splicing.

SUMMARY DISCUSSION OF THE INVENTION

The present invention comprises a unique hinged, split wrap-around or unitary (non-split) hanger having a main seal formed to receive lines, conduits, cables, wires and other threaded components therethrough, the hanger formed to engage and support a tubing string in a tubing head bowl, utilizing the weight of the tubing string and/or log down pins to compress the main seal (the seal preferably formed of compressible material such as, for example, elastomeric material) to seal the wellhead, providing a sealed pass-through for the components threaded therethrough, dispensing without the need for cutting and splicing as in prior art systems.

The preferred embodiment of the invention provides effective, sealed pass-through of power and control cables, lines, conduits, or other components such as for powering an electric submersible pump (ESP) via electrical cable(s), conduit(s) or the like, while effectively packing off and sealing the well bore.

When the hanger is installed on a tubing string with threaded components and positioned to rest in the bowl of the tubing head, the lower string weight compresses the main seal around the pipe, wire conduit, capillary tube or other components as well as the bowl, sealing off the well bore below.

The hanger of the present invention has side doors formed therein to engage and anchor or grip the line, conduit, cable and/or wire (the exemplary embodiment shows the sealing of an ESP power conduit), as well as a capillary line or other components passing though the hanger seal, forming the component seal.

The present invention teaches permanent as well as temporary versions of the installation, and is designed to provide a pressure seal, the permanent version contemplating a hanger formed to engage the tubing and further including a cap formed to envelope the tubing head. The cap utilizes compression fittings about the conduit and capillaries, sealing and locking the installation. The temporary version can be used with any conventional wellhead system, allowing the well to be secured overnight without having to cut the ESP power conduit or capillary line to seal the well.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
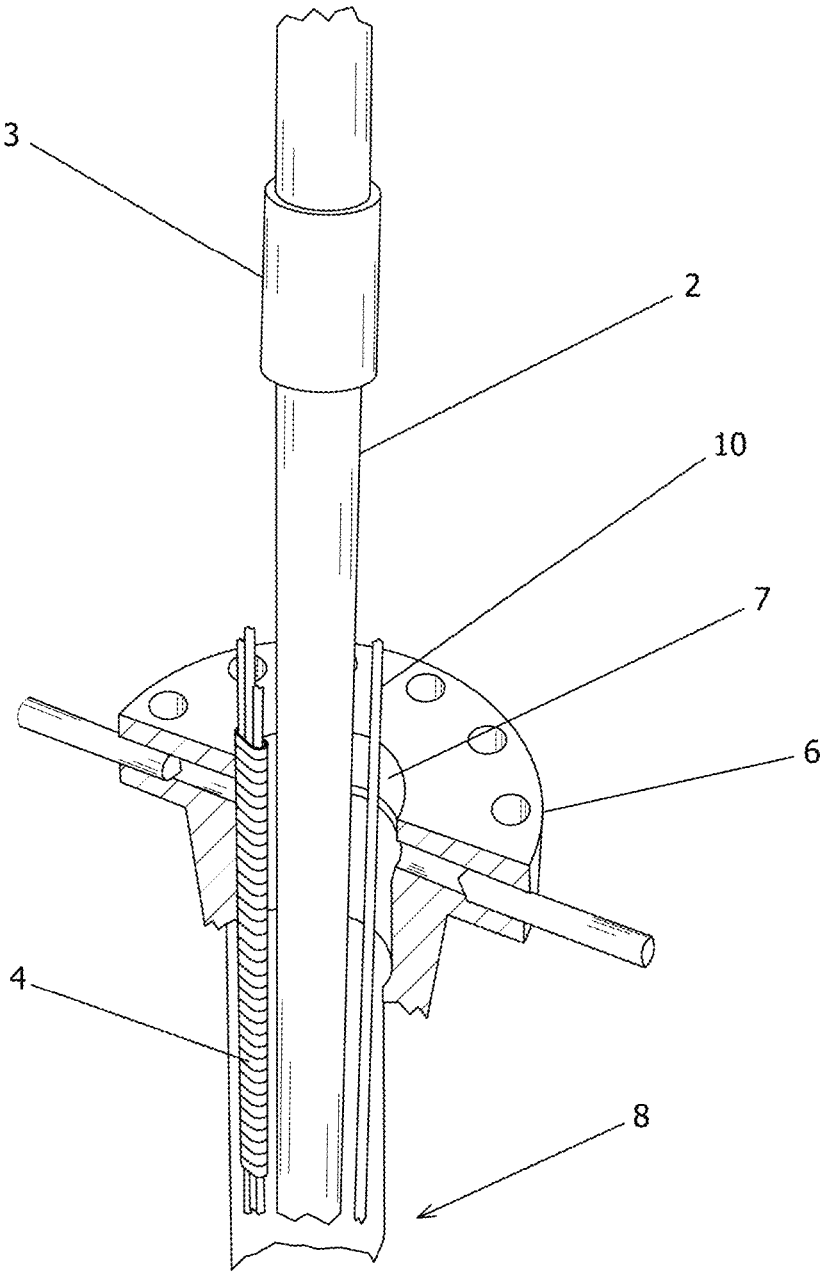
FIG. 1 is a perspective view of a wellhead illustrating a string of tubing emanating from a tubing head, with three conductor jacketed ESP power cable and capillary tube shown.
Figure 2:
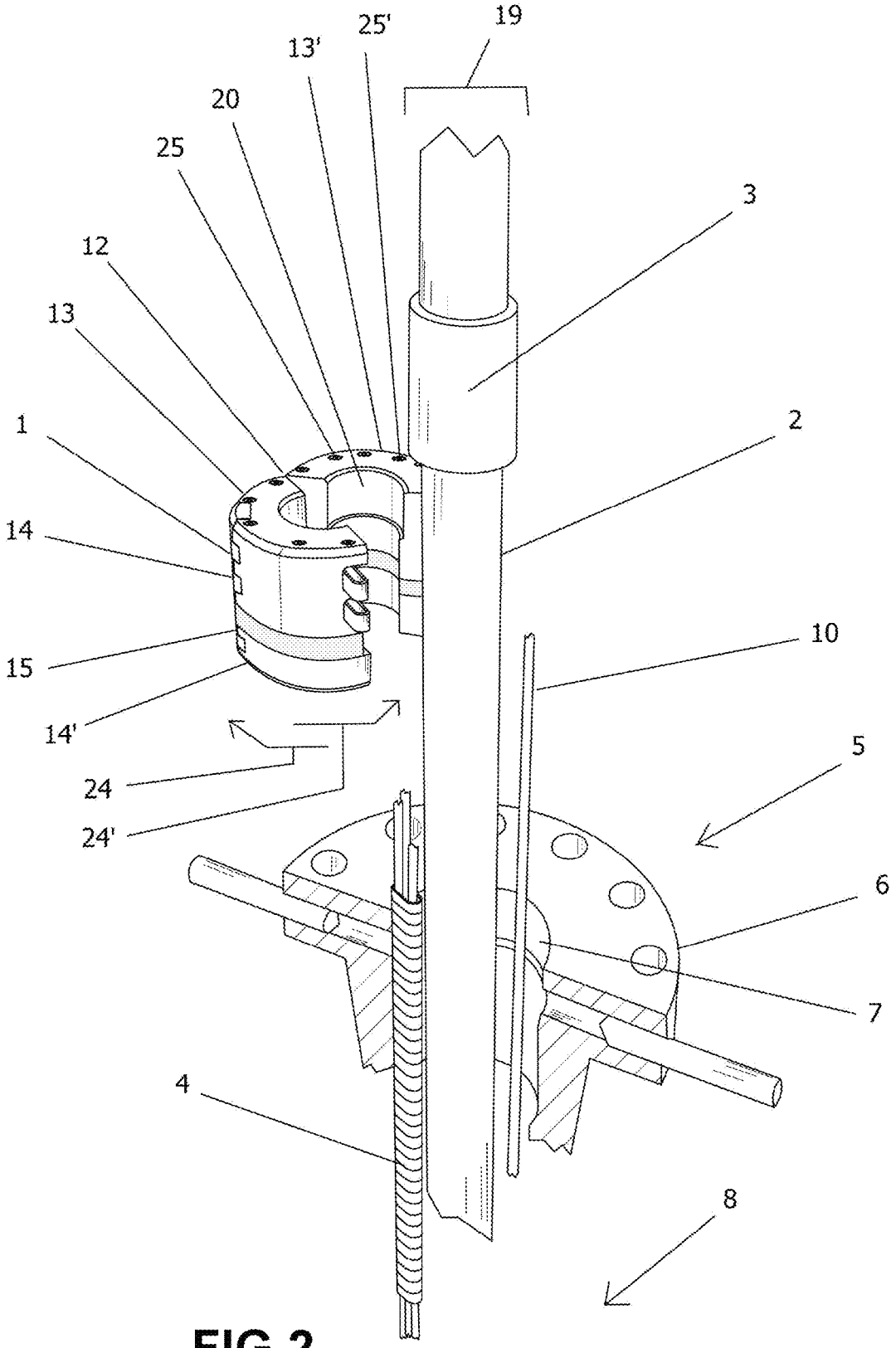
FIG. 2 is perspective view of the wellhead of FIG. 1, further illustrating the wrap-around hanger of the preferred embodiment of the present invention situated to engage the tubing below the coupling, as utilized for a temporary installation (no pressure/back pressure valve (BPV)).

Referring to FIG. 1, the present invention provides a system to pack-off and seal the wellbore 5 having tubing 2 emanating therefrom and the like (connected via collar 3) via improvements in the hanger system, while providing a sealed pass-through of power cables 4, lines (including the capillary line 10) and/or various other conduits, tubes, wires and the like, utilizing the hanger to seal the area of the tubing head 6 at the bowl 7. The present invention is particularly useful in conjunction with sealing the well bore when utilizing downhole an electric submersible pump (ESP) 8, but may also be utilized with many other downhole applications requiring lines, cables, conduits and other components for monitoring, controlling and other operations involving downhole equipment, implements, tools, controls, sensors and the like.

Temporary Side Door Hanger System for Sealing a Pass Through in a Wellhead

Continuing with FIGS. 2-9, the first embodiment of the present invention comprises a system to provide on a temporary or short-term basis a pass-through seal of a wellhead having components comprising a split, wrap-around hanger 1 formed of first 13 and second 13' hanger sections hinged 12 on one side to pivot from open 24 to closed 24' positions forming hanger 1, the opening of same allowing the positioning of said sections about tubing 2 to envelope same. Each hanger component 13, 13' comprises an upper 14 and lower 14' opposing hanger bodies formed of steel or the like (the lower 14' hanger body may alternatively be referred to as the base plate), and with a hanger seal or main seal 15 of synthetic rubber or other elastomeric compound or the like situated therebetween. Bolts 25, 25' threadingly engage upper 14 and lower 14' hanger bodies, passing through seal 15 (via bolt passages formed therethrough, joining same).

The first 13 and second 13' hanger components forming hanger 1, forms a receiver which is formed to encircle tubing 2, and is latched via hinge buckles 17, 17' and locked in place via bolts 18, 18', The closed hanger 1 forms a passage or receiver 21 having an ID 20 of suitable size to slidably receive or otherwise engage the outer diameter 19 of tubing 2.

The hanger of the present invention has situated on opposing its outer surface on opposing sides first 26 and second 26' sets of side doors (See FIGS. 3 and 4 respectively) formed therein to engage grip and selectively hold the line, conduit, cable and/or wire (the figures illustrate the sealing of an ESP power conduit via first 26 door), as well as a capillary line via second 26', to the hanger 1.

Continuing with the Figures, each door 26, 26' is split to form upper 27, 28 and lower 27', 28' door sections, respectively, divided by the main seal 15, which main seal is situated between the upper and lower doors and is not covered about its inner or outer periphery so as not to encumber its operation.

The first 26 and second 26' hinge doors are formed to pivot 23 on one end, and latch closed via bolts 29, 29', respectively, each of which engage and retain the upper and lower doors via in-line bolt passages. The first 26 and second 26' doors when closed cover component slots 30, 31, formed in the hanger 1, respectively, each slot configured to receive and formed to allow the pass-through of a component such as a conduit, line, tube, cable, or the like. In the present case, door 26 is formed to cover and engage (as will be discussed herein) an ESP power cable 4 situated in slot 30 thereunder (when closed), while door 26' covers and engages capillary line 10 situated in slot 31.

Continuing with FIGS. 3-6, the upper door sections 27, 28 of side doors 26, 26' respectively have a gripping profile 22, 22' on the inner side of the doors 27, 28 respectively, the profile formed to engage the outer surface of the component threaded therethrough.

The respective component slot areas 30, 31, in the upper doors 27, 28 area likewise have gripping profiles 34, 34' opposing gripping profiles 22, 22' when the respective doors are closed, which gripping profiles, which may be formed in the hanger or may comprise inserts mounted to the hanger, as shown in the figures, so that when the respective upper door sections 27, 28 are closed 37, 37' about their respective threaded component (in the illustrated example, the ESP power cable 11 and control line 10, respectively), the respective component is gripped thereby. Where an insert 34, 34' is used to provide the gripping profile, the inserts may be changed, along with the respective door sections, to change the gripping profiles to fit various components as required.

Figure 5:
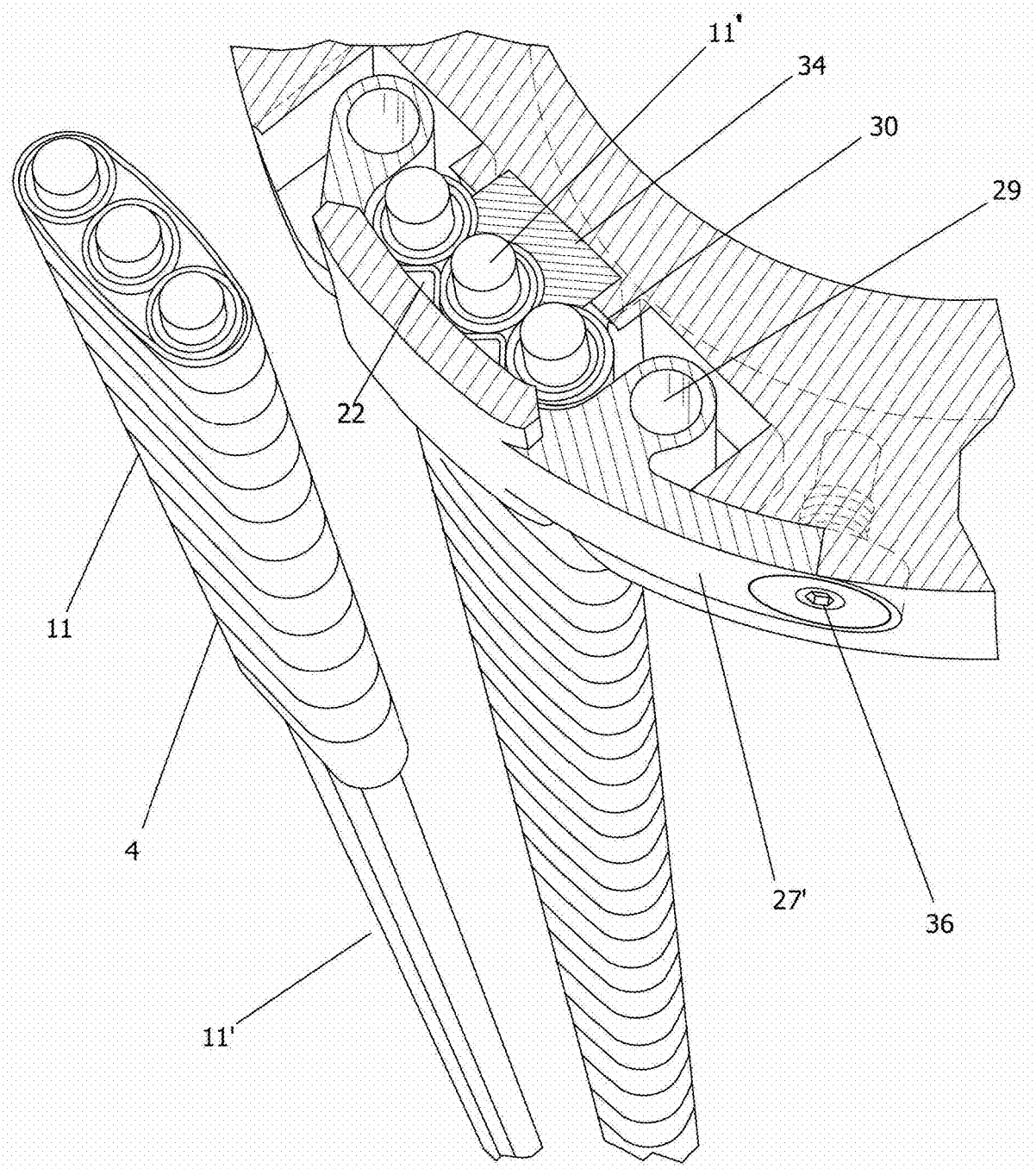
FIG. 5 is a perspective view, partially cut-away view of the ESP power cable threaded through the first upper door of FIG. 4A.
Figure 6:
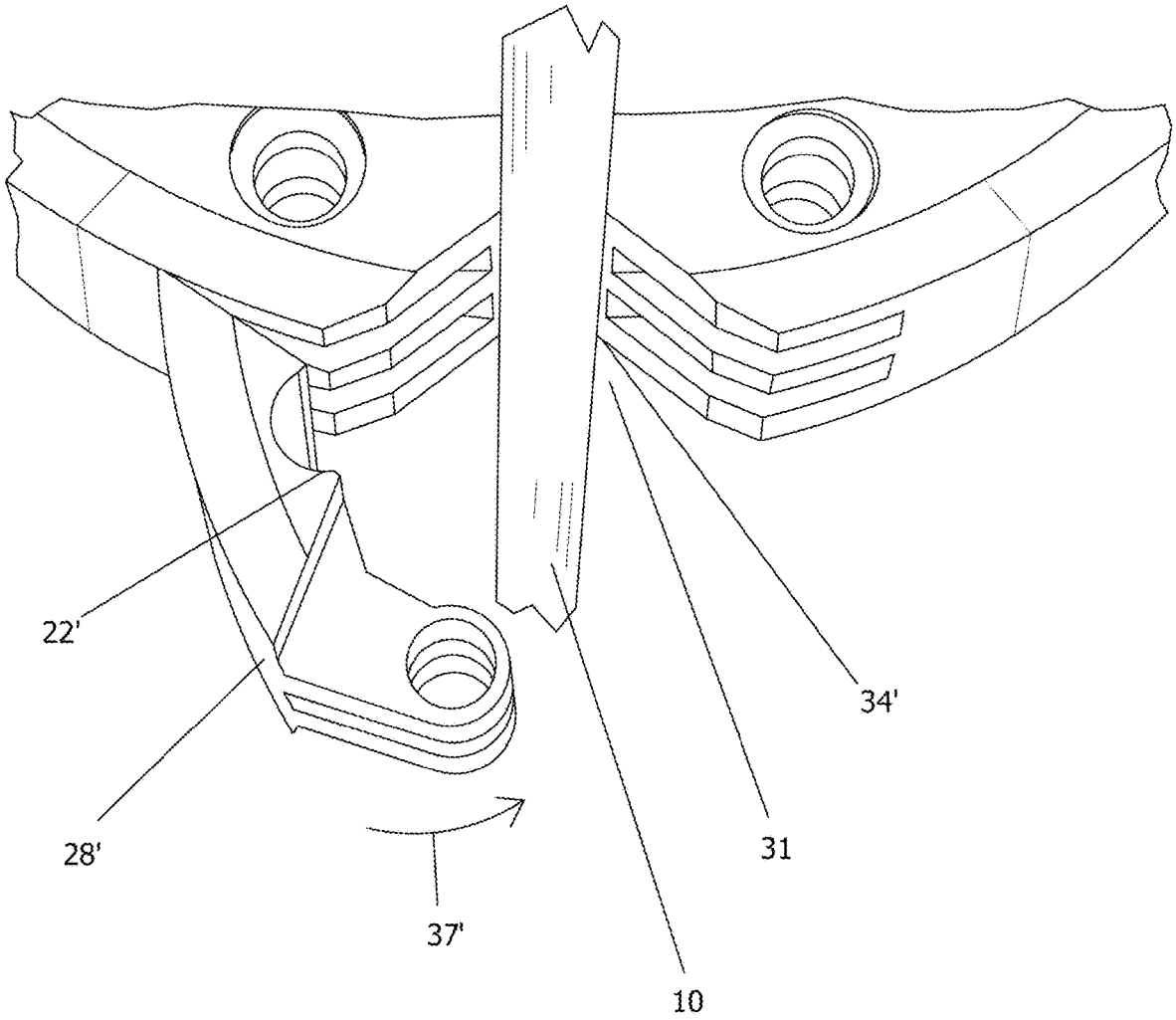
FIG. 6 is a perspective, partial close-up view of the capillary conduit of the second upper side door of FIG. 4 with a capillary in position, further illustrating the inner profile grip as well as the door profile grip formed to engage the opposing side of the capillary tube, so that when the upper door is closed the capillary tube is gripped and retained.

The gripping profiles 22, 22' and 34, 34' are positioned to engage and respectively grip opposing sides of the component threaded therethrough. Latch bolt 36 is provided to threadingly close and retain the door 27 in position, while the hinged or pivotal action in closing the respective door section 27, 27' can be used with fulcrum effect to facilitate the application of pressure to the outer surface of the component thereunder by the gripping surface, to provide a secure grip thereto, as shown in FIG. 5. No pressure seal need be associated with the side doors in the preferred embodiment of the present invention, as it is the main seal which provides the sealing action.

Figure 3:
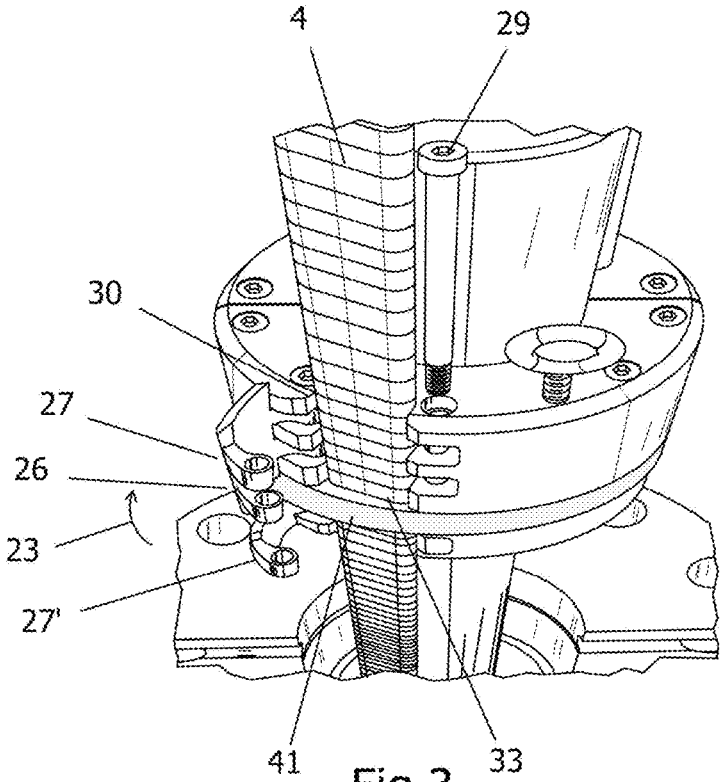
FIG. 3 is a perspective view of the invention of FIG. 2, illustrating the wrap-around hanger situated about the tubing, with first side doors opened and ESP power cable threaded through the main seal.
Figure 4:
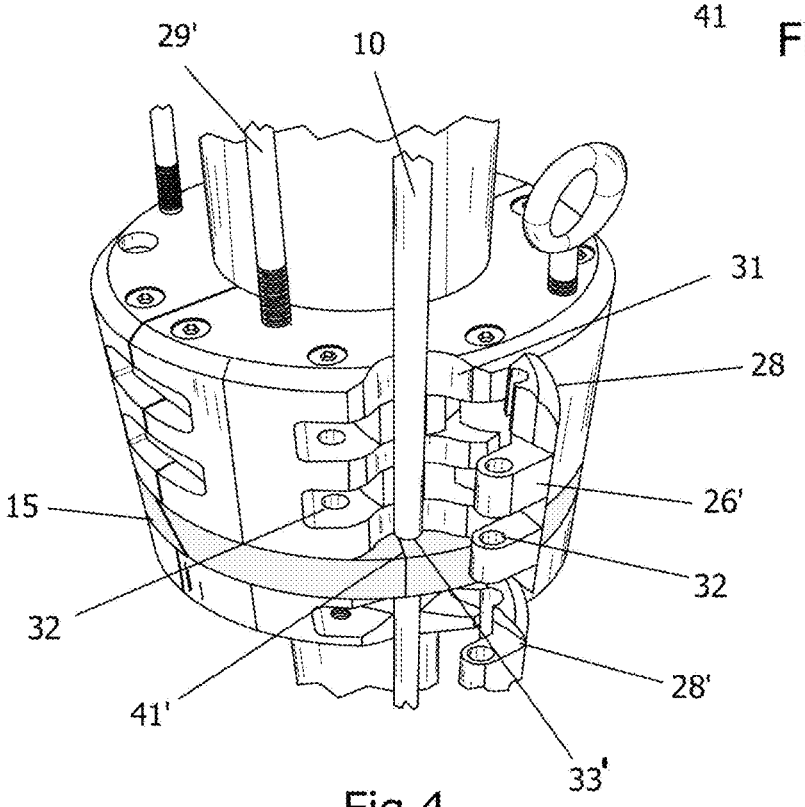
FIG. 4 is a perspective view of the invention of FIG. 3, illustrating the wrap-around hanger situated about the tubing, with second side doors opened and capillary tubing threaded through the main seal.
Figure 4A:
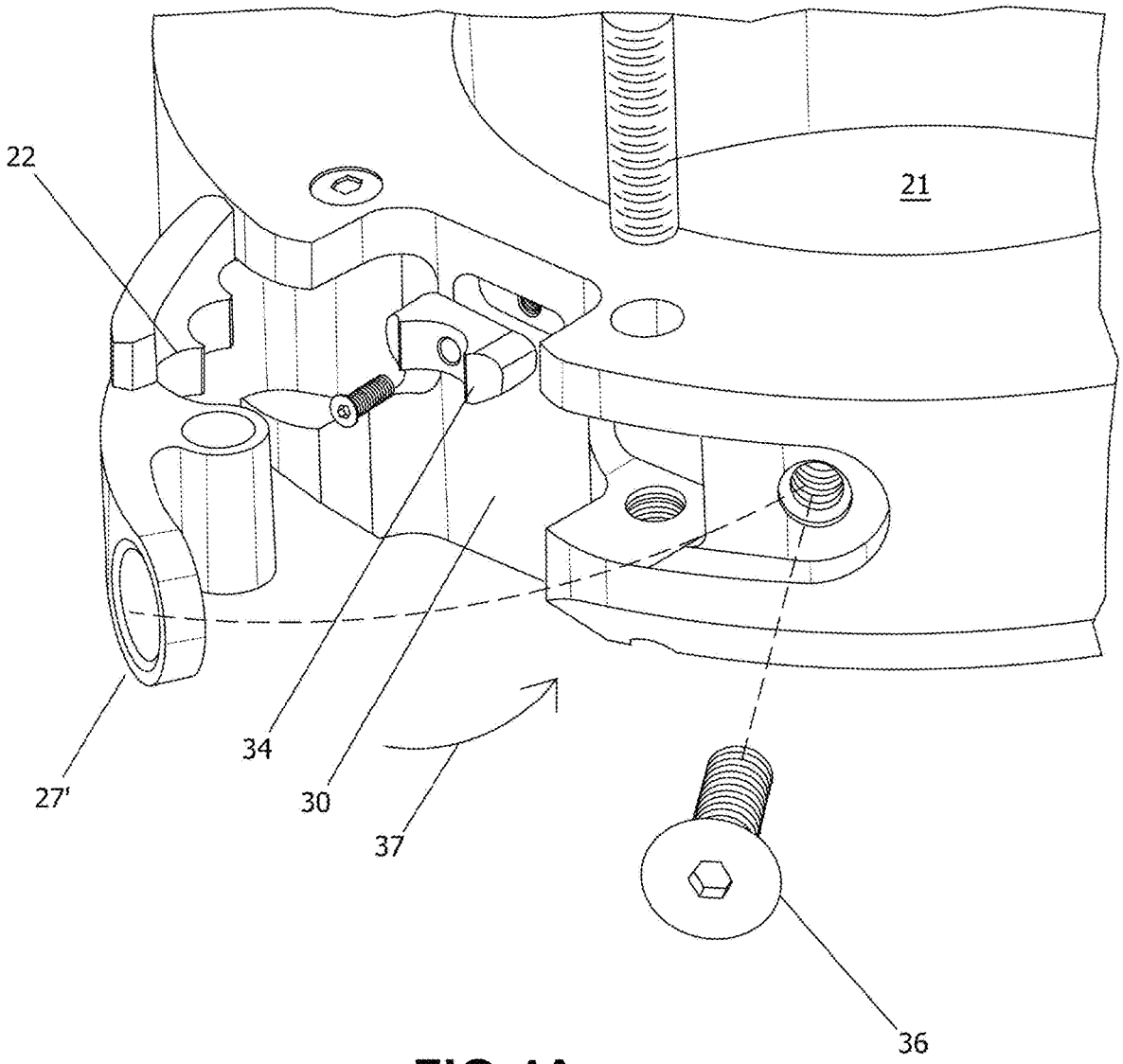
FIG. 4A is a perspective, partial, close-up of the invention of FIG. 3, illustrating the first door in open position to receive the ESP power cable, and further illustrating in exploded form the inner profile grip which is threadingly engaged to the hanger in the ESP power cable receiving area, as well as the door profile grip formed to engage the opposing side of the ESP power cable, so that when the upper door is closed the ESP power cable (or other component) situated therein is gripped and retained. Also shown is a threaded allen bolt for fastening the upper door in closed, gripping position.

As shown in FIGS. 3 and 4, the main seal 15 has formed therethrough, in axial alignment with the component slots 30, 31, passages 33, 33' formed to allow the passage of the respective component through the seal, in this case, the power cable 4 and capillary line 10, respectively. Further, the main seal may have slits 41, 41' formed through the outer diameter to the passage 33, 33' respectively, to facilitate the insertion/removal of the component through the slit to the passage, so that the components may be threaded therethrough as needed without having to run the end of the component through the passage. The passages 33, 33' would be formed to allow the profile of the respective component to be threaded through, with nominal clearance thereabout to facilitate sealing of the seal 15 about the threaded component when pressure is applied to the seal, as will be discussed infra.

In the case of ESP power cable 4 and possibly other components having a protective jacket, the protective jacket 11 of the cable can be removed to expose the insulated wires 11' for the portion which is threaded through seal 15 (via slit 41) to passage 33, to ensure a pressure-tight, sealed pass-through in use.

Figure 7:
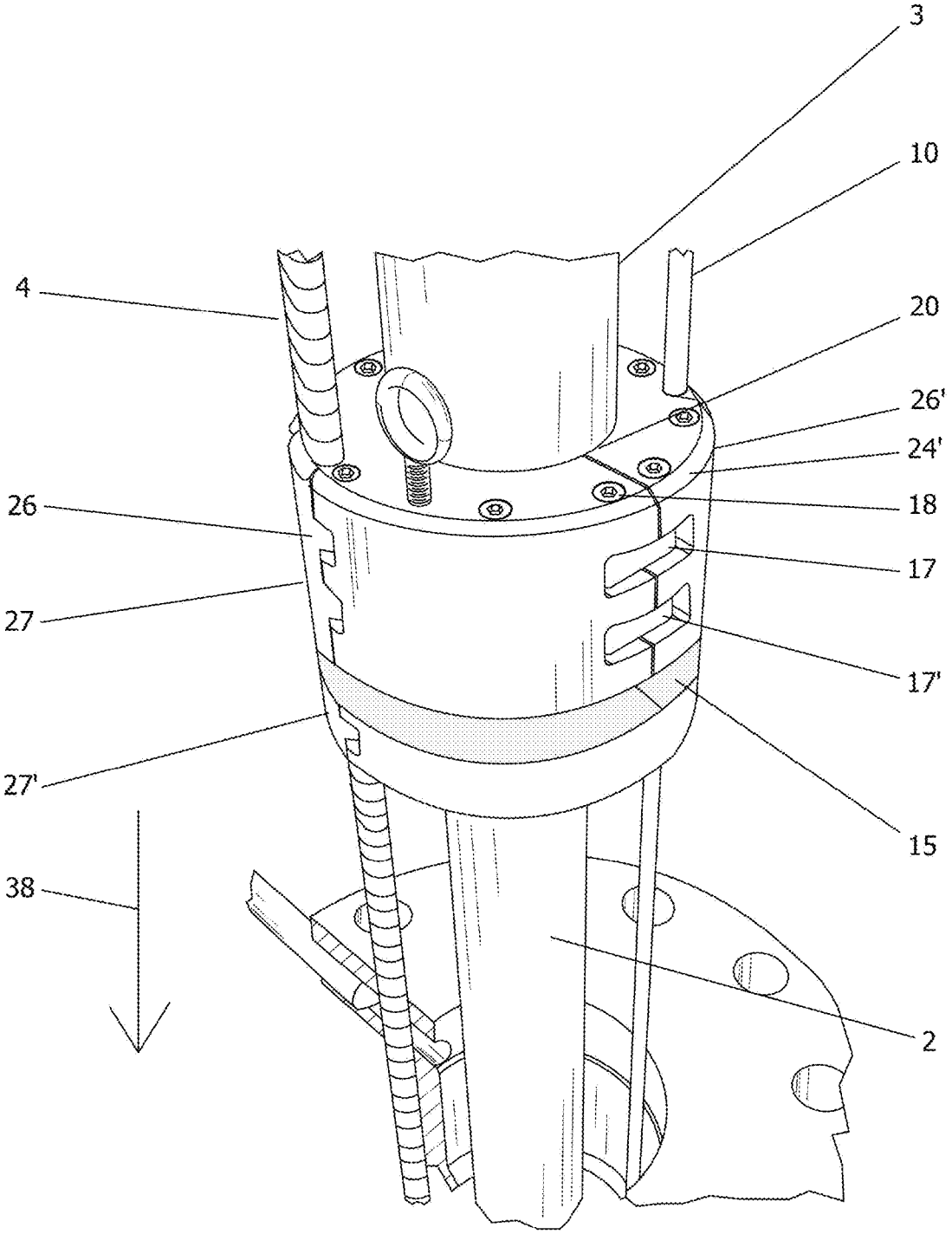
FIG. 7 is a perspective view of the invention of FIG. 6, illustrating the wrap-around hanger secured about the tubing string with the ESP power cable and capillary tube secured by their respective first and second doors.
Figure 8:
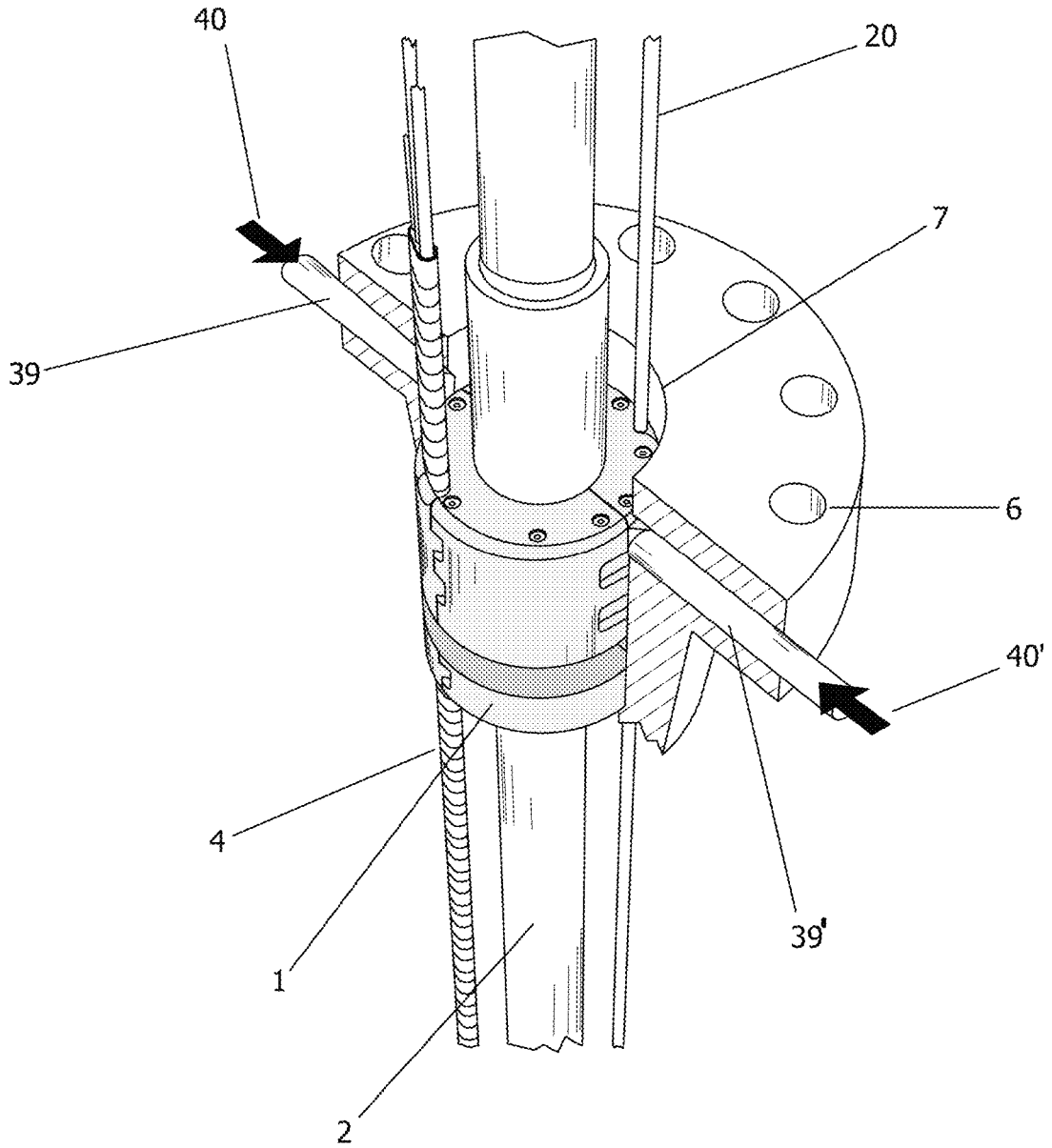
FIG. 8 is a perspective view of the invention of FIG. 7, illustrating the wrap around hanger with ESP power cable and capillary tube situated about the tubing below the collar, and lowered into the tubing head bowl.

Continuing with FIGS. 4-7, with the wrap-around hanger 1 situated about the tube 2 below the collar 3, and the upper 27, 28 and lower 27', 28' of first 26 and second 26's doors closed about and gripping the threaded components as discussed, in this case, ESP power cable 4 and capillary line 10 respectively (as shown in FIG. 7), the tubing string 2 is ready to be lowered so that the hanger 1 is situated in the bowl 7, as shown in FIG. 8, so that the weight of the tubing 2 string rests upon hanger 1, compressing the main seal 15 about the components (in this case, ESP power conduit 4 or cable and capillary line 10), as well as tubing (outer diameter) and bowl (inner diameter), sealing off the well.

As shown in FIG. 8, once the hanger 1 is set in the bowl 7, hold down pins 39, 39' are positioned 40, 40' from the tubing head 6 into opposing sides of the hanger 1 to lock the hanger 1 in the bowl 7, and thereby resist over pressure downhole urging the hanger/string out of the bowl.

Figure 9:
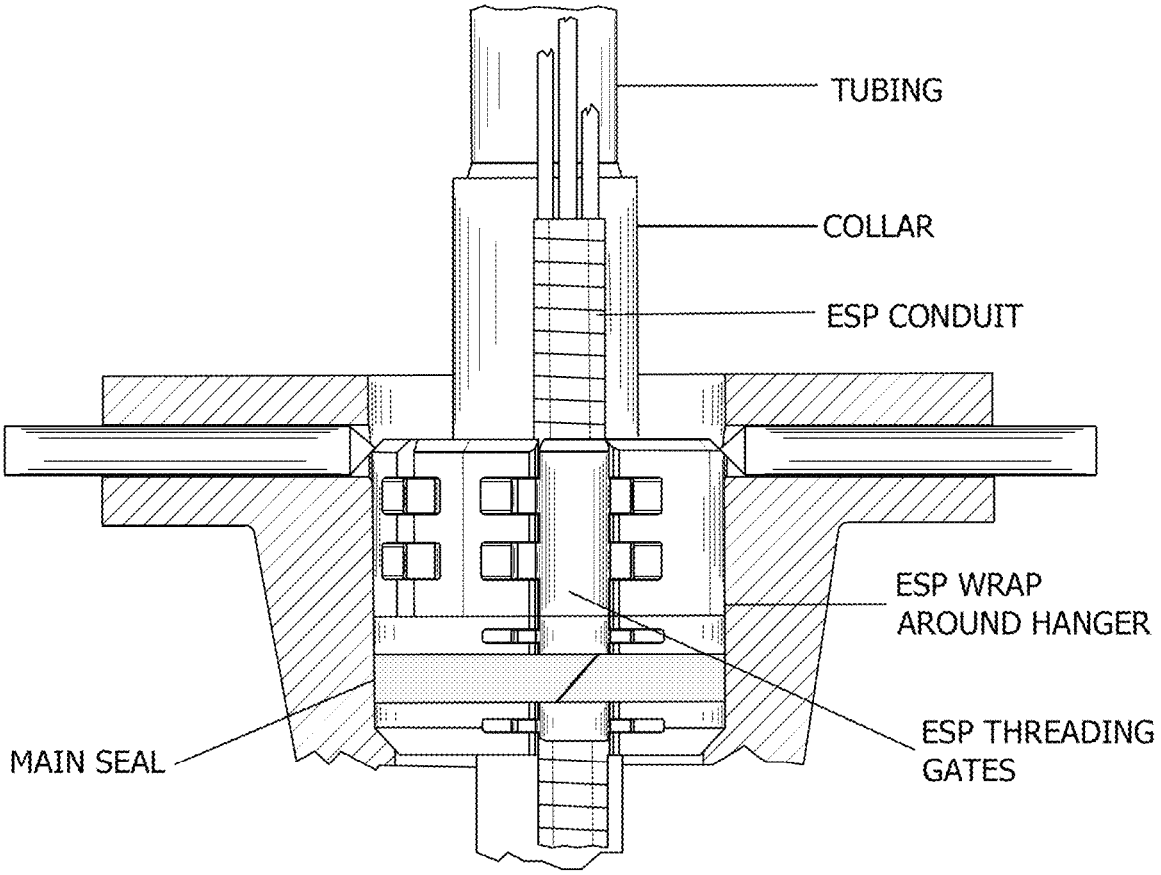
FIG. 9 is a side, partially cut-away, partially cross-sectional view of the wrap around hanger with the tubing hanging therefrom, and the hanger string compressing the main seal about the ESP conduit.

Continuing with FIG. 9, with the hanger installed about a tubing string with threaded components therein and positioned to rest in the bowl of the tubing head, the lower string weight compresses the main seal about the pipe, components (i.e., ESP power cable or other wire conduit, capillary tube or other components) as well as the bowl at the same time, sealing off the well bore below while sealing the threaded components.

The unique main seal of the present invention, being formed to receive lines, conduits, cables, wires and other components therethrough, coupled with the unique side doors formed in the hanger to engage and support a tubing string on a hanger, facilitates the utilization of the main seal to provide the pass-through of the components while effectively sealing the wellhead without the need for cutting and splicing the component(s) passing therethrough.

The temporary version of the present invention, disclosed above, is suitable for use with any conventional wellhead system on a short-term or temporary basis, such as to allow a well having an electric submersible pump (ESP) downhole to be secured overnight, without the need to remove the ESP or to cut the ESP power conduit or capillary line to seal the well.

Long-Term Side Door Hanger System for Sealing a Pass-Through in a Wellhead

The second embodiment of the invention provides a permanent or long-term pass-through hanger system for sealing a well having components such as ESP power cables, capillary lines, or like emanating therefrom.

Referring to FIGS. 11-22 of the figures, the pass-through hanger system of the second embodiment of the invention 50 has a similar hanger configuration and sealing action as the first embodiment (for short term or temporary use), with some differences, as will be detailed below.

Figure 10:
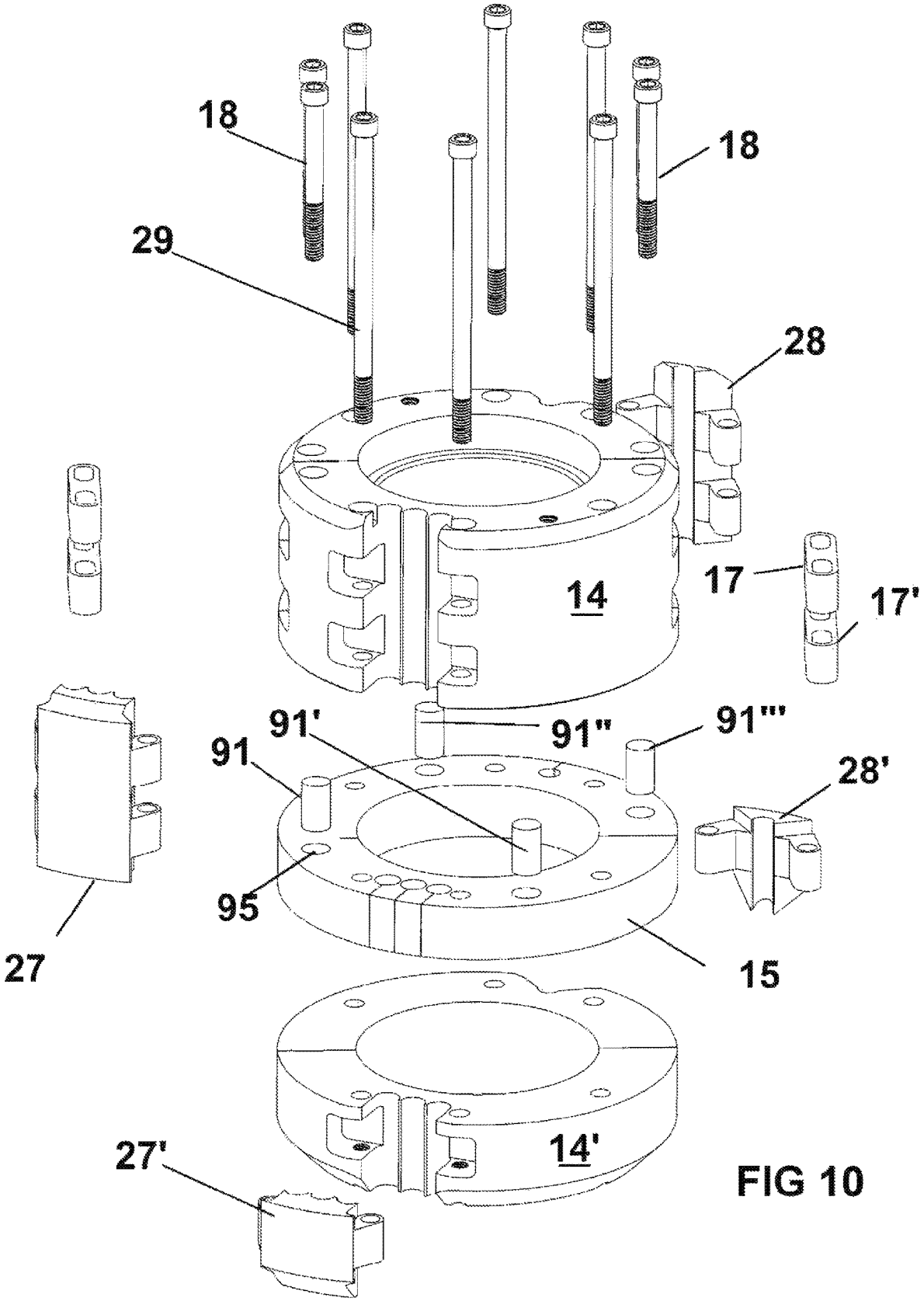
FIG. 10 is a perspective, exploded view of the wrap around hanger of the present invention, illustrating the various components forming same.
Figure 11:
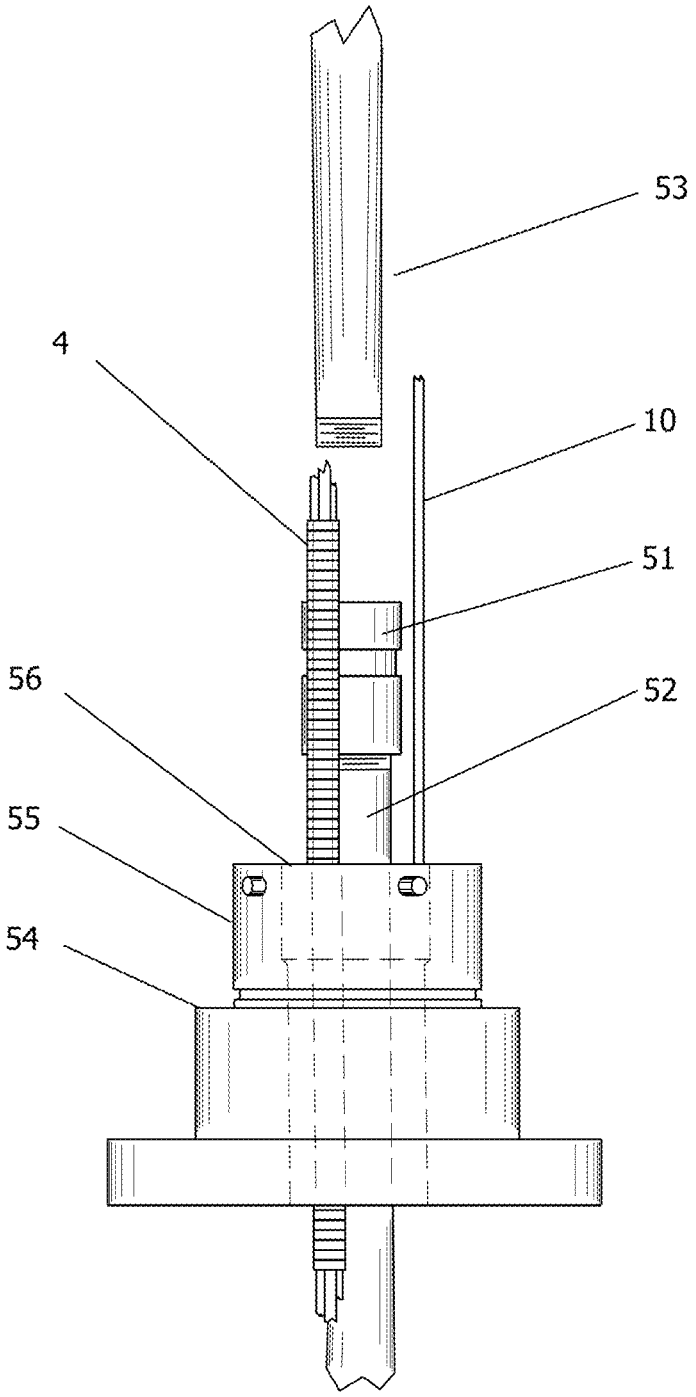
FIG. 11 is a perspective view of a wellhead illustrating a string of tubing emanating from a modular tubing head having a completion coupling engaged thereto with a three conductor jacketed ESP power cable and capillary tube shown.
Figure 12:
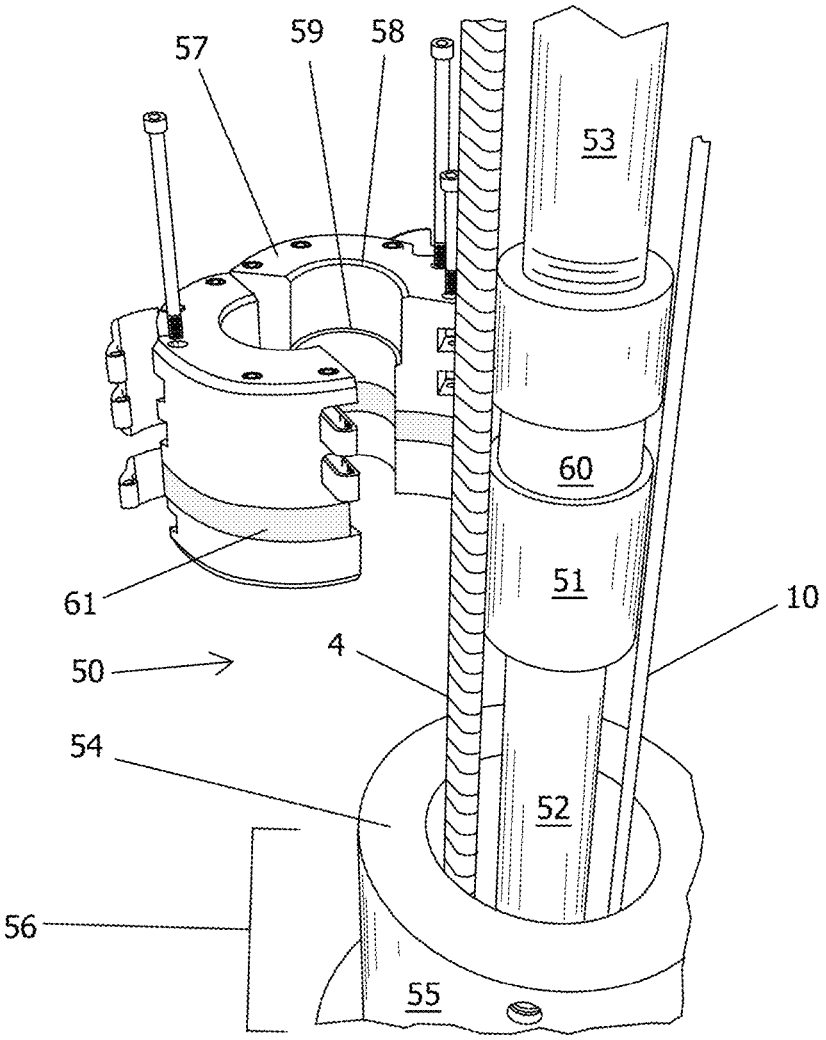
FIG. 12 is perspective view of the wellhead of FIG. 11, further illustrating the wrap-around hanger of the preferred embodiment of the present invention for use with a permanent or long term pass-through wellhead seal, engaging a completion coupling engaging the completion tubing, the coupling in the present embodiment configured to engage the completion coupling medially.
Figure 13:
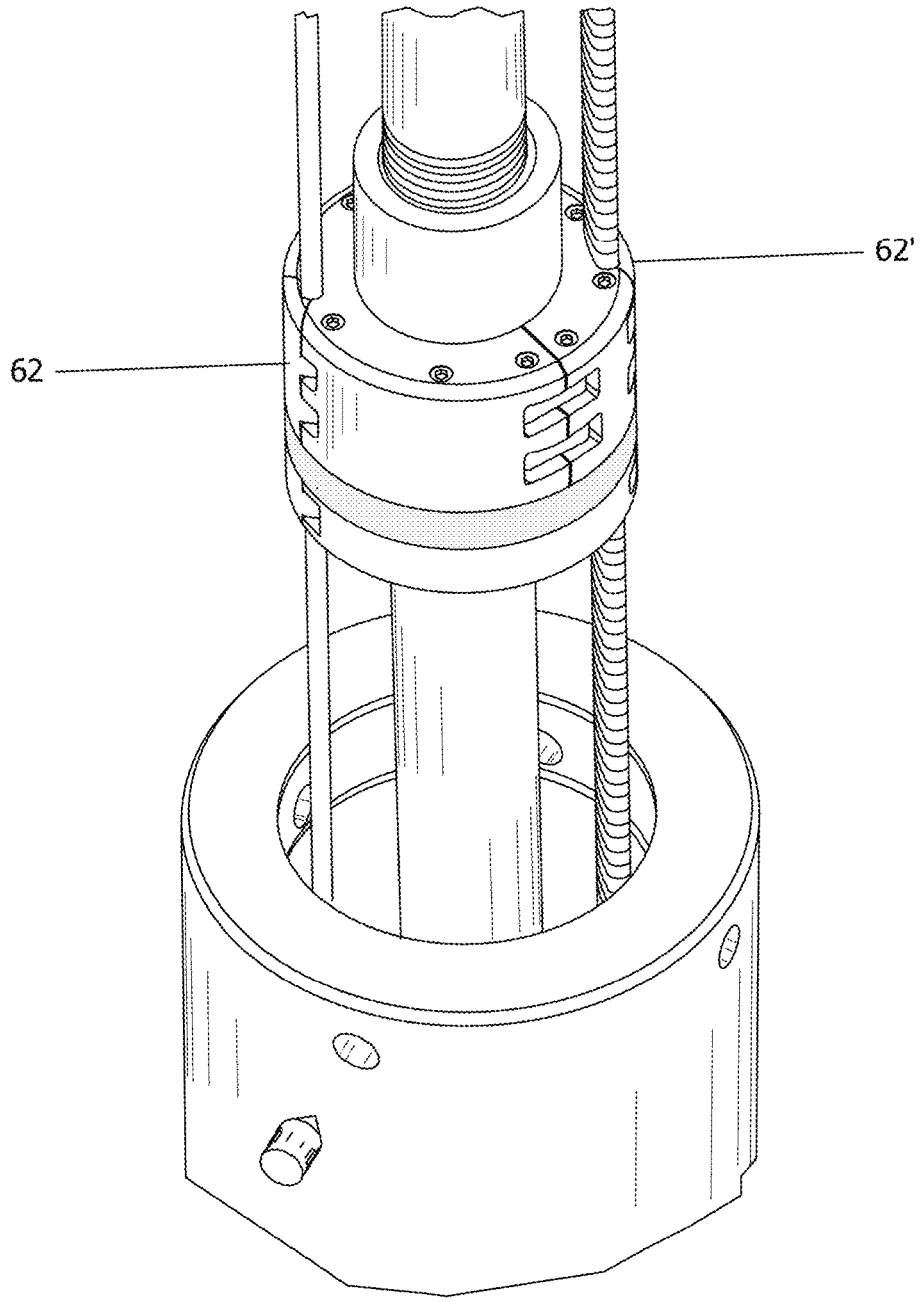
FIG. 13 is a perspective view of the invention of FIG. 12, illustrating the wrap-around hanger situated about the completion coupling with the ESP power cable and capillary tube secured by the first and second upper and lower doors, respectively, of hanger.
Figure 14:
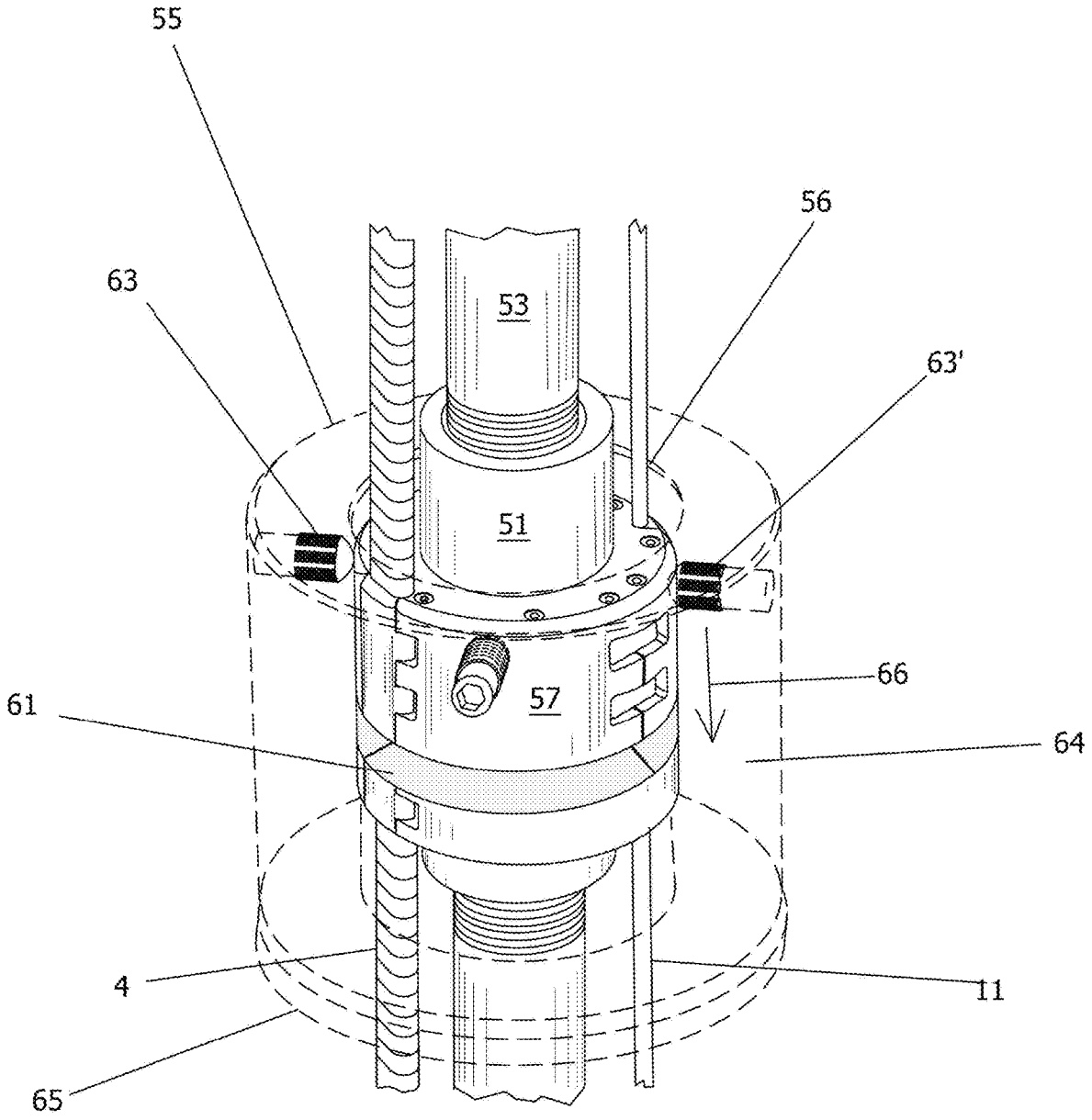
FIG. 14 is a perspective view of the invention of FIG. 13, illustrating the wrap around hanger with ESP power cable and capillary tube situated about the tubing about the coupling, lowered into the tubing head bowl and the weight of the tubing string resting on the hanger to compress the main seal and seal the components threaded therethrough (in this case, the ESP power cable and capillary line), and locking pins provided to lock the hanger in the bowl of the tubing head.
Figure 15:
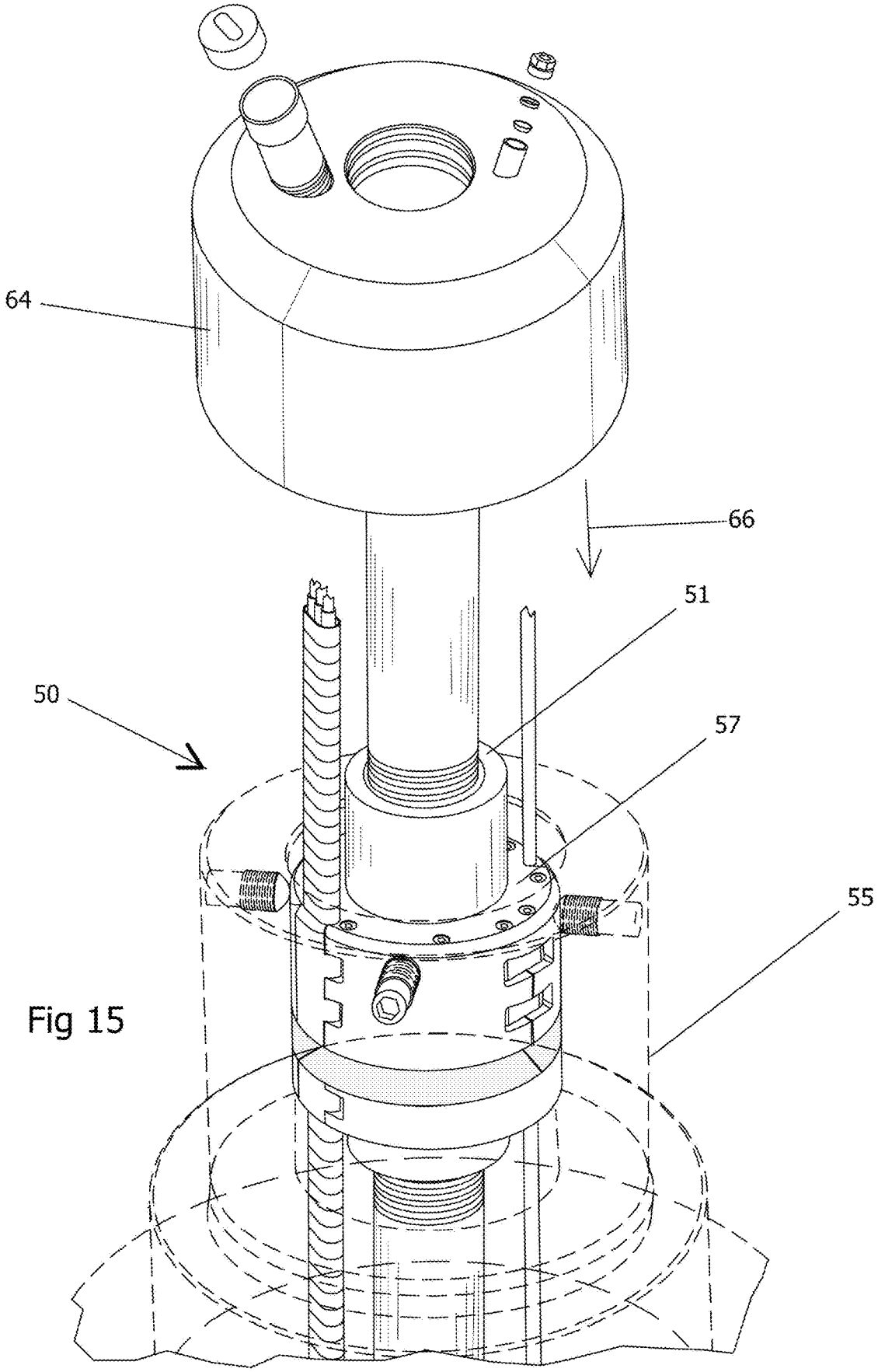
FIG. 15 is a perspective view of the invention of FIG. 14, illustrating the tubing head cap being slipped over the coupling, hanger and bowl area of the tubing head, with top ports and seals for the ESP power line and capillary line, shown respectively, (in exploded form).
Figure 16:
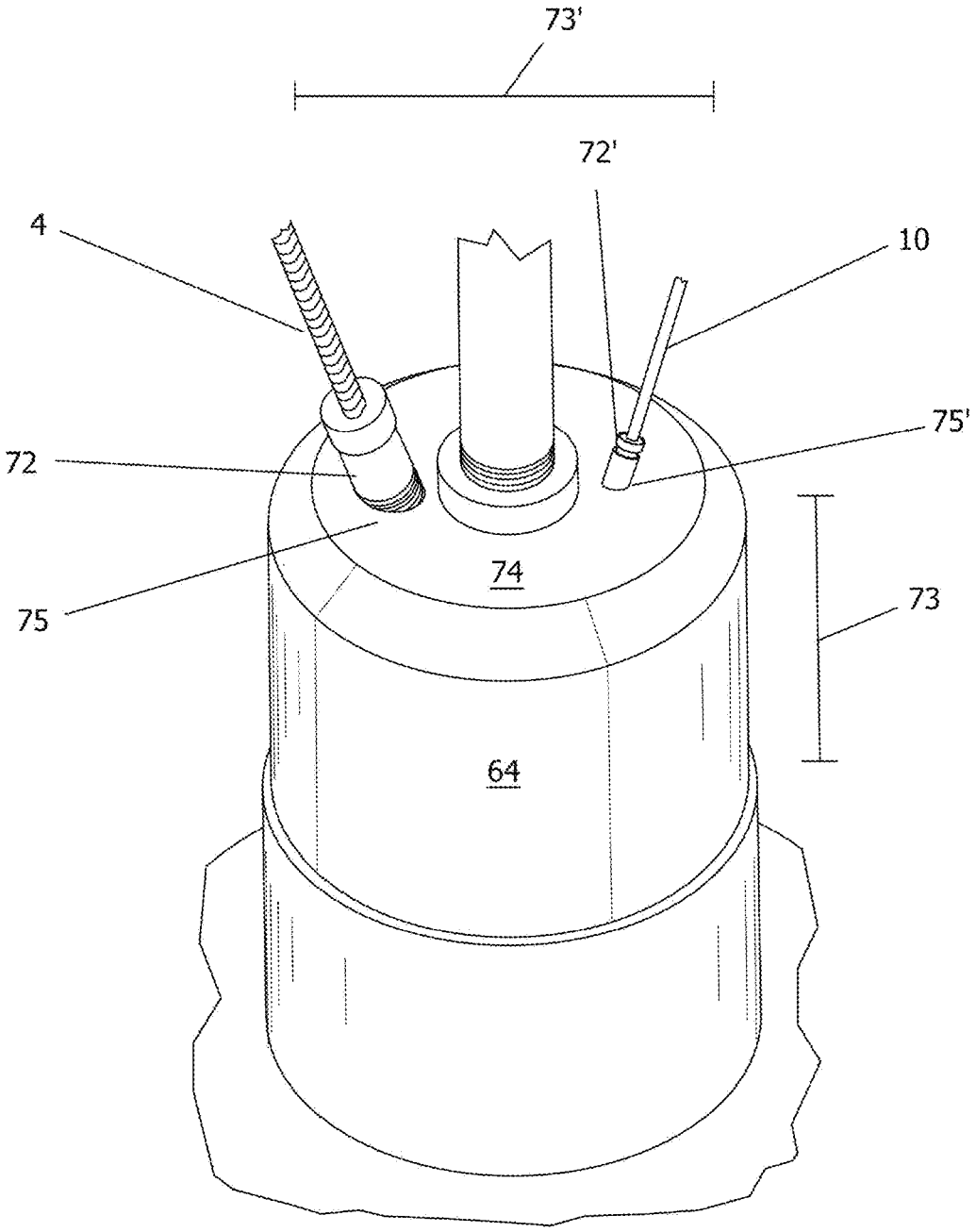
FIG. 16 is a side, perspective view of the invention of FIG. 15, with the cap clipped over neck of the tubing head (about the bowl) and secured thereto, and with ESP power line and capillary line slipped through respective ports and sealed via terminator-like compression fitting for the ESP line.
Figure 17:
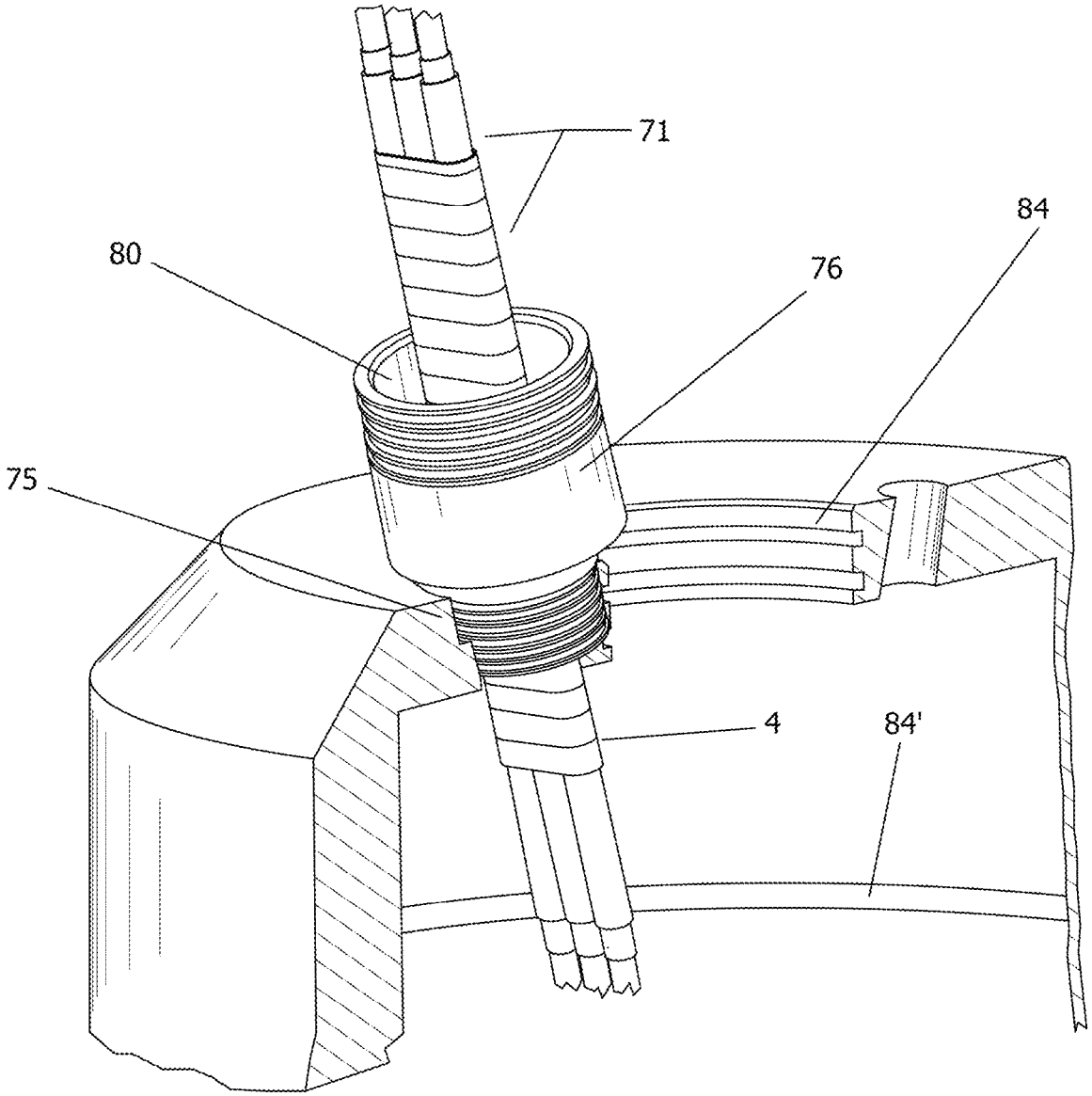
FIG. 17 is a side, perspective, partially cut-away, close-up view of the housing of the ESP power line seal housing engaged to the cap.
Figure 18:
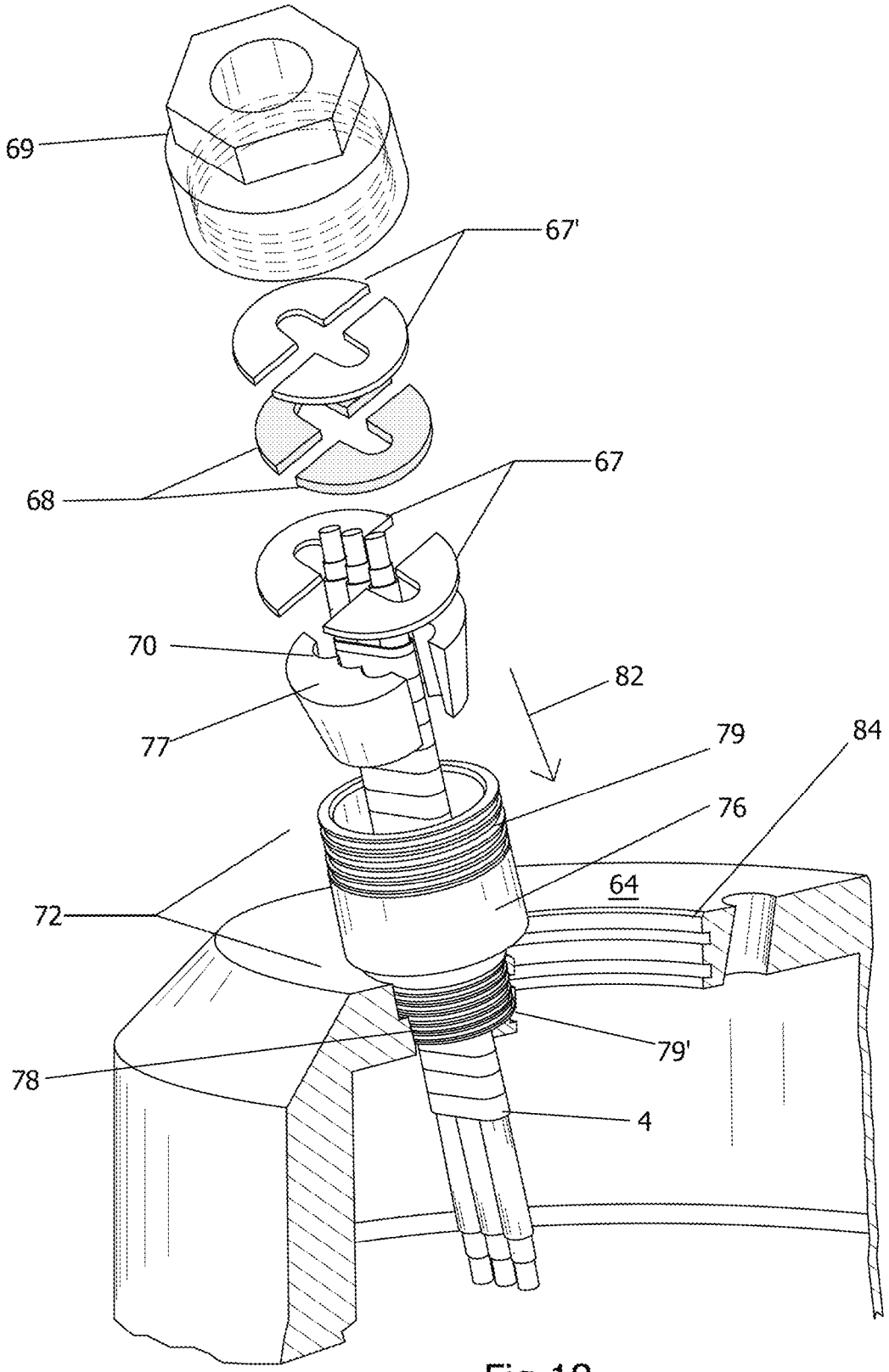
FIG. 18 is a side, perspective, partially cut-away, close-up, exploded view of the ESP line compression seal, illustrating the housing with wedge base, grippers engaging the wedge base, split washers, seals and cap.

Like the first embodiment of the invention, which was designed for short-term use, the second embodiment, intended for long-term or permanent use, utilizes a split or wrap-around hanger 57 which operates in a similar manner to the short-term embodiment, including the configuration of the main seal 61 of the hanger 57 to allow the pass-through of the components such as ESP power cable, control line, capillary line, etc, and utilizing the weight of the tubing string to compress 64 the seal, sealing the components threaded through as well as the bowl and collar, to seal the well. Compression limiters 91-91''' (FIG. 10) may be provided in passages 95 in the main seal 15 to limit the amount of compression in the main seal to maximize the sealing action against the coupling or completion component (depending on the embodiment), components threaded through the seal (eg ESP power cable and control or capillary line), and bowl.

Similarly, the and first and second opposing doors 62, 62' respectively of the hanger 57 include the same operational elements and operate in the same fashion as those disclosed in the first embodiment.

However, the first and second embodiments of the invention do have some important differences. One difference, relates to the mounting of the hanger 57, as in the second embodiment the hanger 57 is formed to engage to a completion coupling 51 (as opposed to the tube as in the first embodiment), the inner diameter 58 of hanger 57 of the second embodiment having a profile to engage and lock onto the completion coupling 51, in this case, the profile comprising a ridge 59 or raised area formed in the ID of the hanger which is formed to engage a slot 60 formed in the completion coupling 51, to engage and lock the hanger 57 to the completion coupling 51 when the hanger is closed, and support the weight of the drill string therefrom when placed in the bowl. The completion coupling is mounted to the threaded end of the tubing 52 via handling pup 53 or the like.

Another difference when comparing the second embodiment of the invention to the first embodiment relates to a specially-configured, modular tubing head (which may incorporate an interchangeable flanged adapter), as opposed to the conventional tubing head of the temporary (or shorter term) hanger system earlier discussed. The modular tubing head 54 of the present invention has a neck 55 area formed to provide the bowl 56 to receive and support the hanger 57, and supported tubing, as well as threaded locking bolts 63, 63' to lock L, L' the hanger in the bowl, to prevent downhole pressure from urging the hanger with tubing from the wellhead, while effectively packing off and sealing the well bore.

In the second embodiment, the neck 55 of the modular tubing head 54 is formed to receive a bowl cap 64 to envelope and seal off the system, as will be further disclosed below. Further details on the modular tubing head 54 and locking bowl cap of the present invention are described in applicant's U.S. Pat. No. 8,485,262 B1 (the '262 patent) issued Jul. 16, 2013 listing present applicant/inventor John W Angers as inventor, the contents of which are incorporated herein by reference thereto.

Continuing with FIGS. 15-21, the bowl cap 64 of the present embodiment of the invention is provided to engage the neck 55 of the modular tubing head 54, sealing off the bowl 56, hanger 57, as well as much of the completion coupling 51. The bowl cap has similarities to that taught in the above '262 patent, the contents of which are incorporated herein by reference thereto. The cap has a height 73 and inner diameter 73' (ID) to slip over envelope the neck 55 of the modular tubing head 54, and engage the base of the neck via groove 65 (or threaded bolts 86, FIG. 22), locking same in place. Gaskets 84, 84' (FIG. 22) may be provided along the inner wall of the bowl to engage and provide a seal about the neck of the modular tubing head upon which the cap is mounted as well as where the completion coupling emanates from the top of the bowl. Further, a gasket 84 may be provided at the opening of the bowl cap 64 to engage the outer diameter of the completion coupling.

Continuing with FIGS. 15-20, unlike earlier versions of the bowl cap disclosed in the '262 patent, the bowl cap 64 of the present invention incorporates sealed, pass-through compression fittings 72, 72' in the top of the unit for components passing therethrough, in this case, the ESP Power line 4 and capillary line 10, which pass out of the top 74 of the bowl cap 64 via first 75 and second 75' apertures via first 72 and second 72' compression fittings, respectively.

The first 72 compression fitting, suitable for the ESP power line 4 or the like (jacketed or un-jacketed) comprises a housing 76 formed to threadingly engage (via threaded area 78) the top of the bowl cap, the housing providing a sealed passage out of the bowl cap for the passage of the component (in this case, the ESP line) therethrough. The housing 76 has first 79 and second 79' ends, and provides a terminator-like compression fitting which will compress and seal about the electric line.

A split insert 77 is placed about opposing sides of the ESP power line 4 and has a frustoconical form 83 (i.e., having an outer diameter varying from wide to narrow) to engage the inner walls of the housing, which taper from wide to narrow toward threaded area 78 from the first 79 end, providing a wedge-lock type compression seal. The opposing split portions of insert 77 are formed to engage the component, in this case, the ESP power line 4 along its width 71, the insert portion or gripper contacting the component, sandwiching same, the insert 77 having formed therein a contact profile 70 formed to match or be compressed to form the outer profile of the component on each side, to provide a seal therebetween, while the insert 77 side contacting the inner housing wall is formed to have a contact profile (in this case, a radial profile) to fully engage the inner housing 76 in sealing fashion, and/or be compressible to form said profile when engaging same in use.

In use, the threaded portion 78 of the housing 79 is threadingly engaged to the top 74 of bowl cap, the component (in this case the ESP power line 8) is passed through the housing 79, the appropriate split insert 77 is selected having the right profile or composition to seal the component, then opposing sides of the insert are situated in the housing to sandwich the component.

Figure 19:
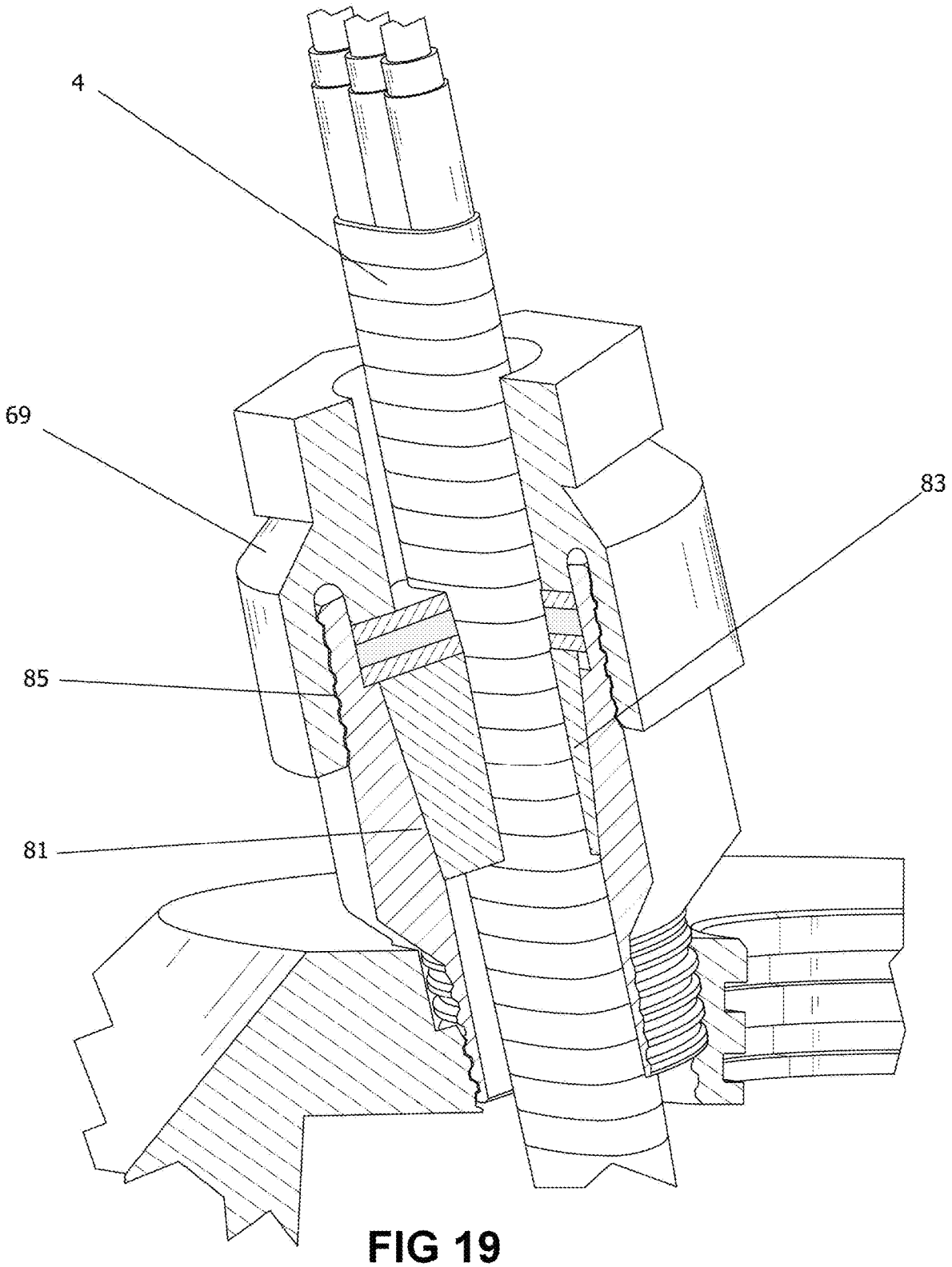
FIG. 19 is a partially cut-away, close-up, partially cross-sectional view of the ESP line compression seal of FIG. 18, illustrating the seal enveloping the ESP power line in sealed fashion.

Then rubber or elastomeric 68, and metal 67, 67' split spacers are stacked upon the inserts, alternating the type of spacers as shown (with preferably metal spacers engaging the cap 69 and insert 77), then threaded cap 69 is applied to threadingly engage (via threads 85) the housing, the threaded engagement applying pressure to the spacers and insert and urging same into 82 the housing 76, so that the frustoconical form 83 of the insert engages the taper 81 formed in the inner walls of housing, urging the insert in sealed engagement against the component (ESP power line 8) and inner walls of the housing, to provide a compression seal about same, (as shown in FIG. 19).

As shown, the spacers 67, 67', 68 have channels formed therein to receive the component, and can thus vary in size, shape and material depending in profile depending on the component utilized.

Other pass-through components are likewise sealed similarly, each component preferably passing through its own aperture formed in the top of the bowl cap 64, such as, in the present case, the capillary line 10 is sealed via a second compression fitting 72' associated with the second aperture 75' in the bowl cap 64, although a third party compression fitting may be used depending on the component involved and the sealing requirements. For example, for the capillary line, a third party (for example, SWEDGELOCK brand compression fitting) may be suitable.

Figure 20:
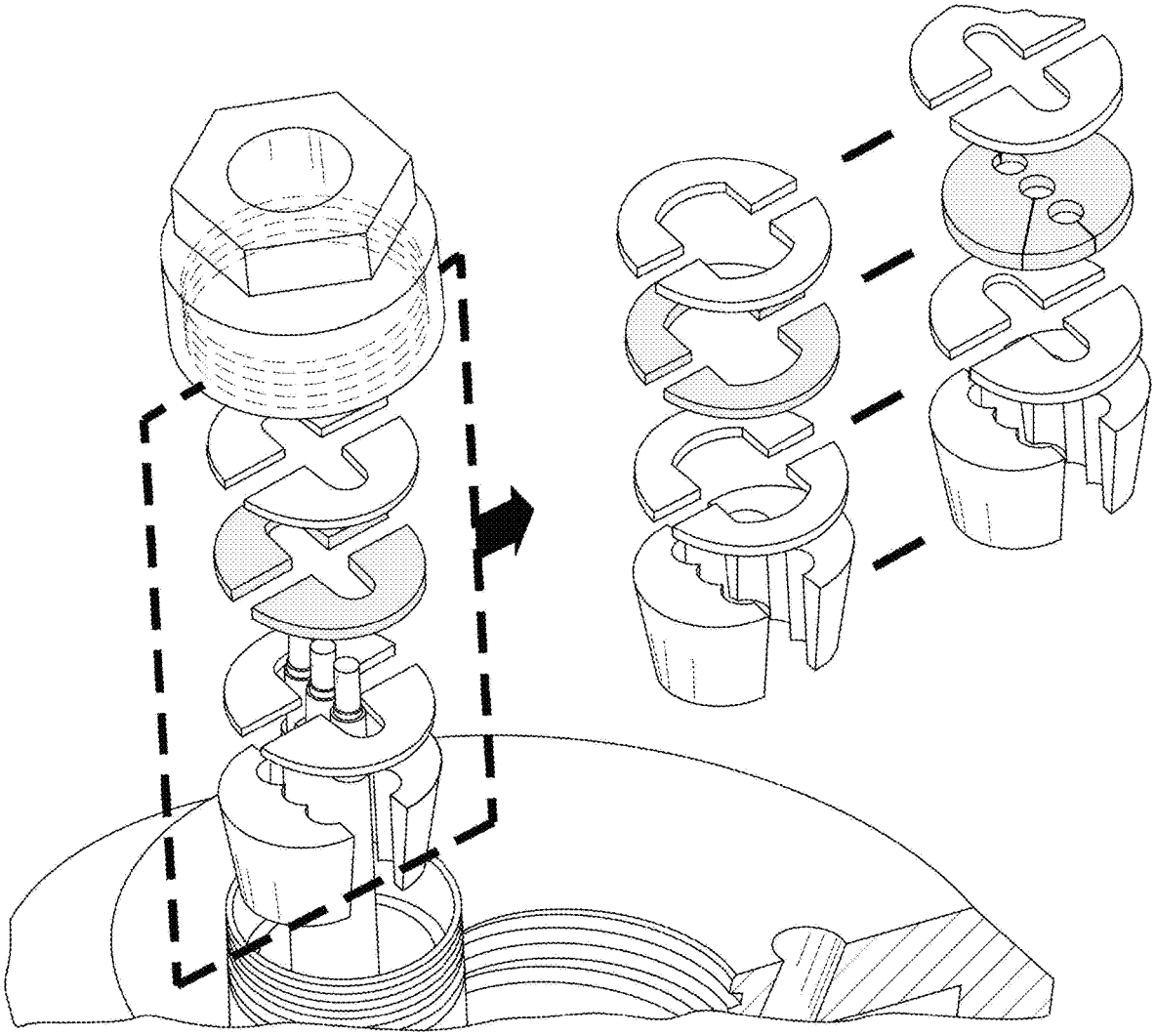
FIG. 20 is a side, perspective, partial, close-up view of the invention of FIG. 18, further illustrating alternative component pass-through configurations for the grippers, wedge lock-type seals and washers.
Figure 20A:
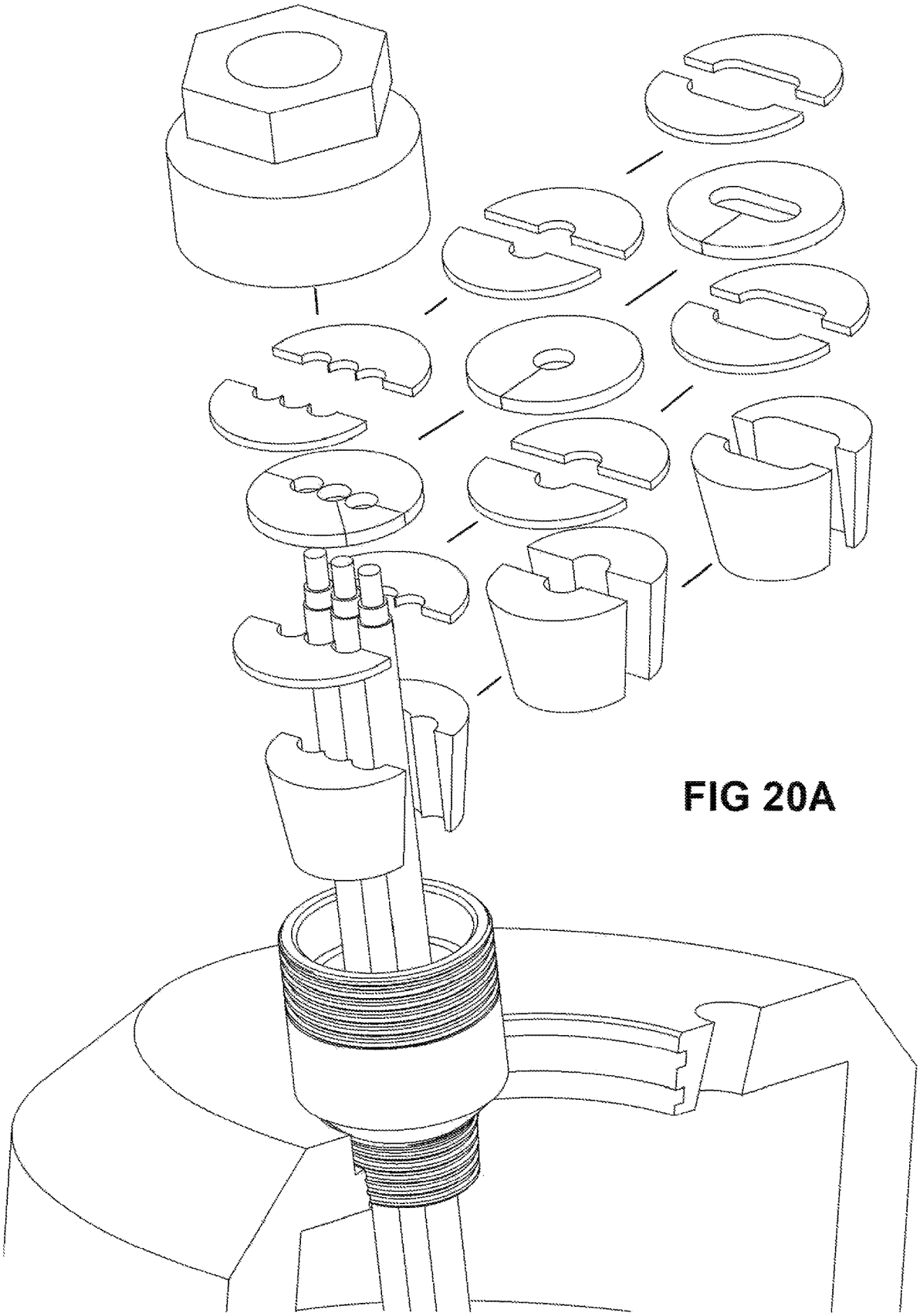
FIG. 20A is a side, perspective line drawing of the invention of FIG. 20, illustrating still other configuration grippers/seals and washers.
Figure 21:
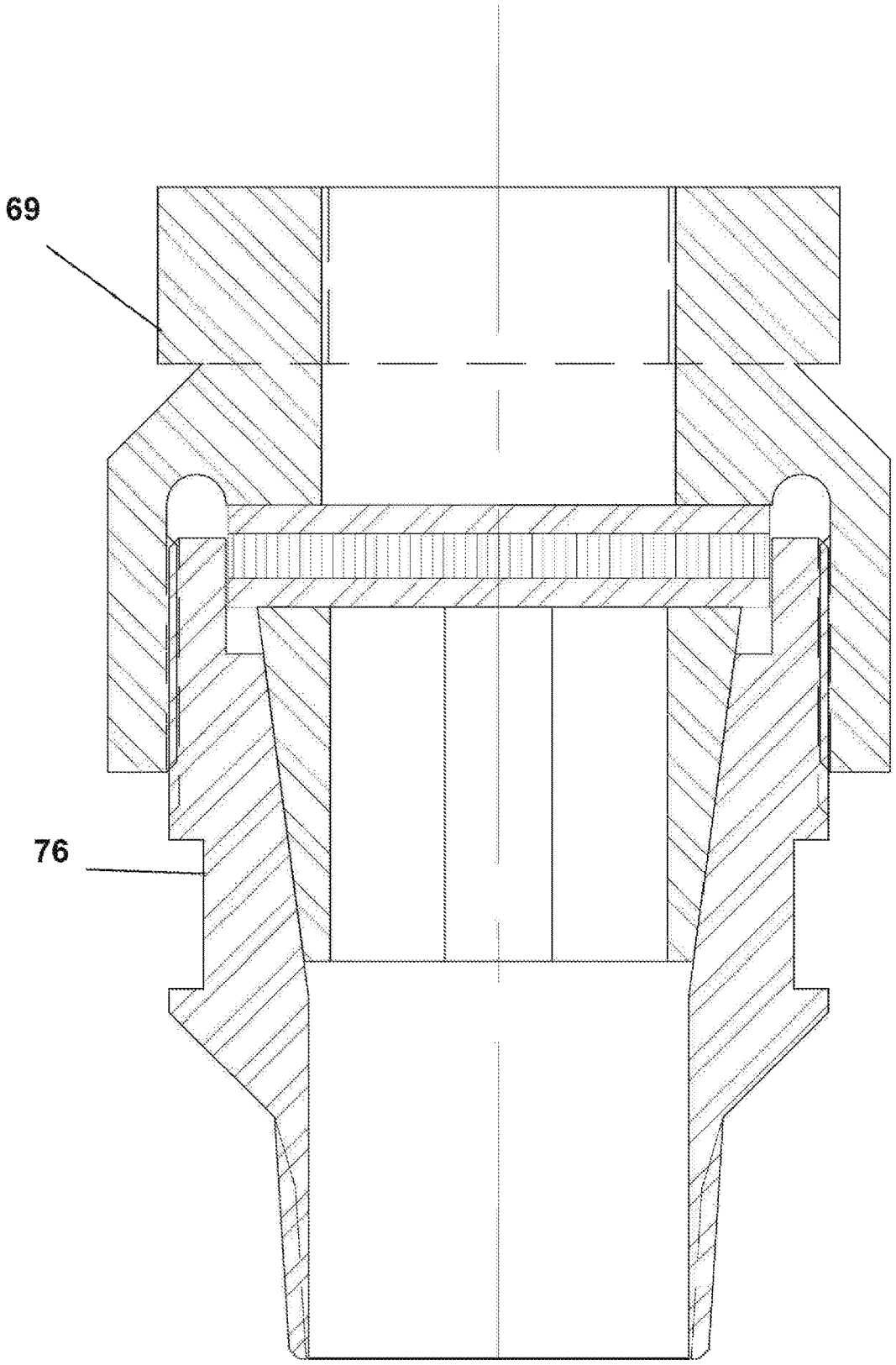
FIG. 21 is a side, cross-sectional view of the device of FIG. 20, illustrating the wedge base, cap, and overall configuration of the compression seal housing.
Figure 22:
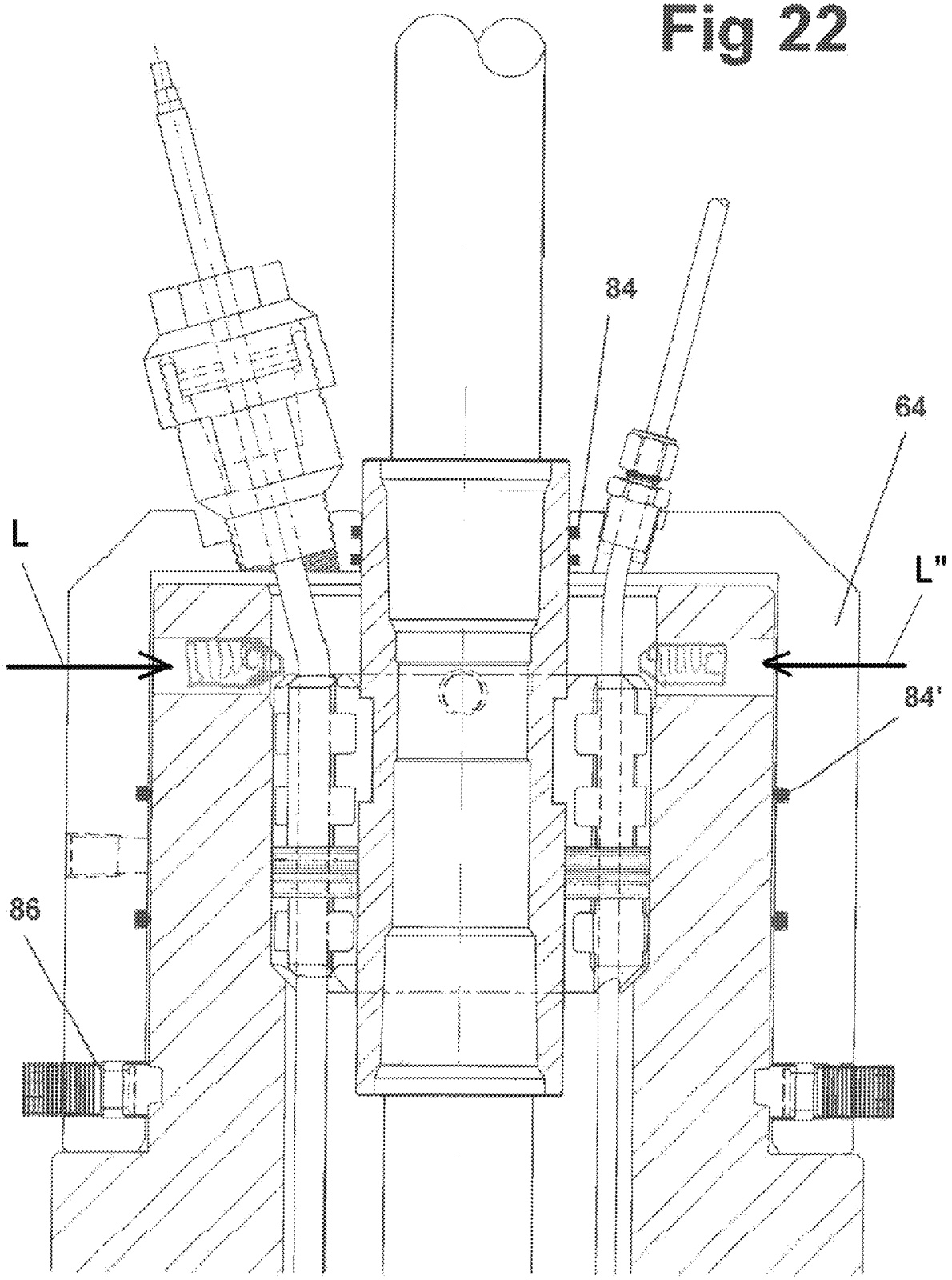
FIG. 22 is a side, partially cross-sectional view of the invention of FIG. 16, illustrating the hanger in the bowl with the weight of the string thereupon to expand the main seal to engage the bowl, completion coupling, ESP power line and capillary line components, sealing off the well, and the cap with compression seals thereon.
Figure 22A:
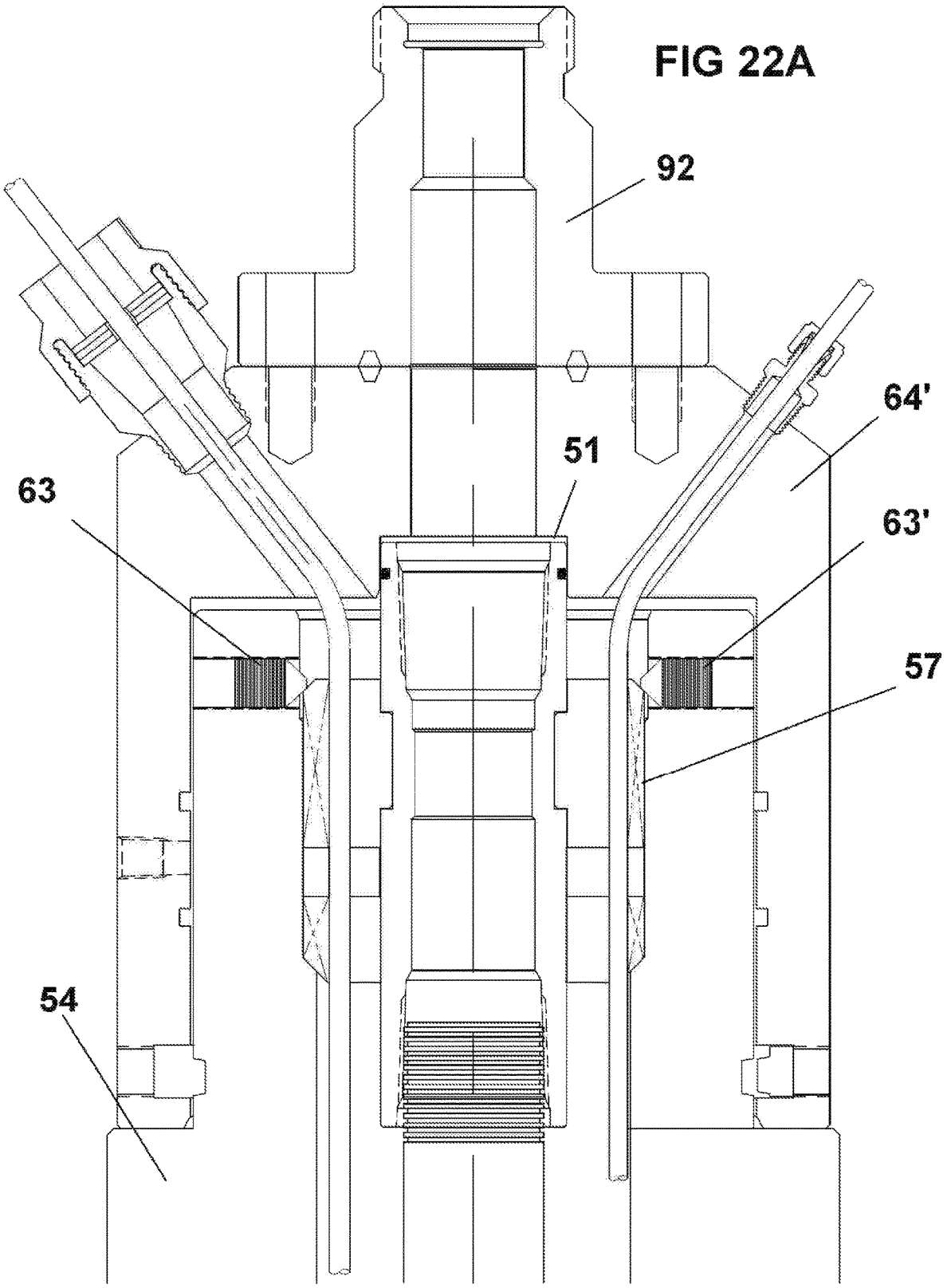
FIG. 22A is a side, partially cross-sectional, partially cut-away view of the invention of FIG. 22 mounted to a modular wellhead 54, illustrating an alternative cap 64' having a flanged mount to engage component 92.
Figure 22B:
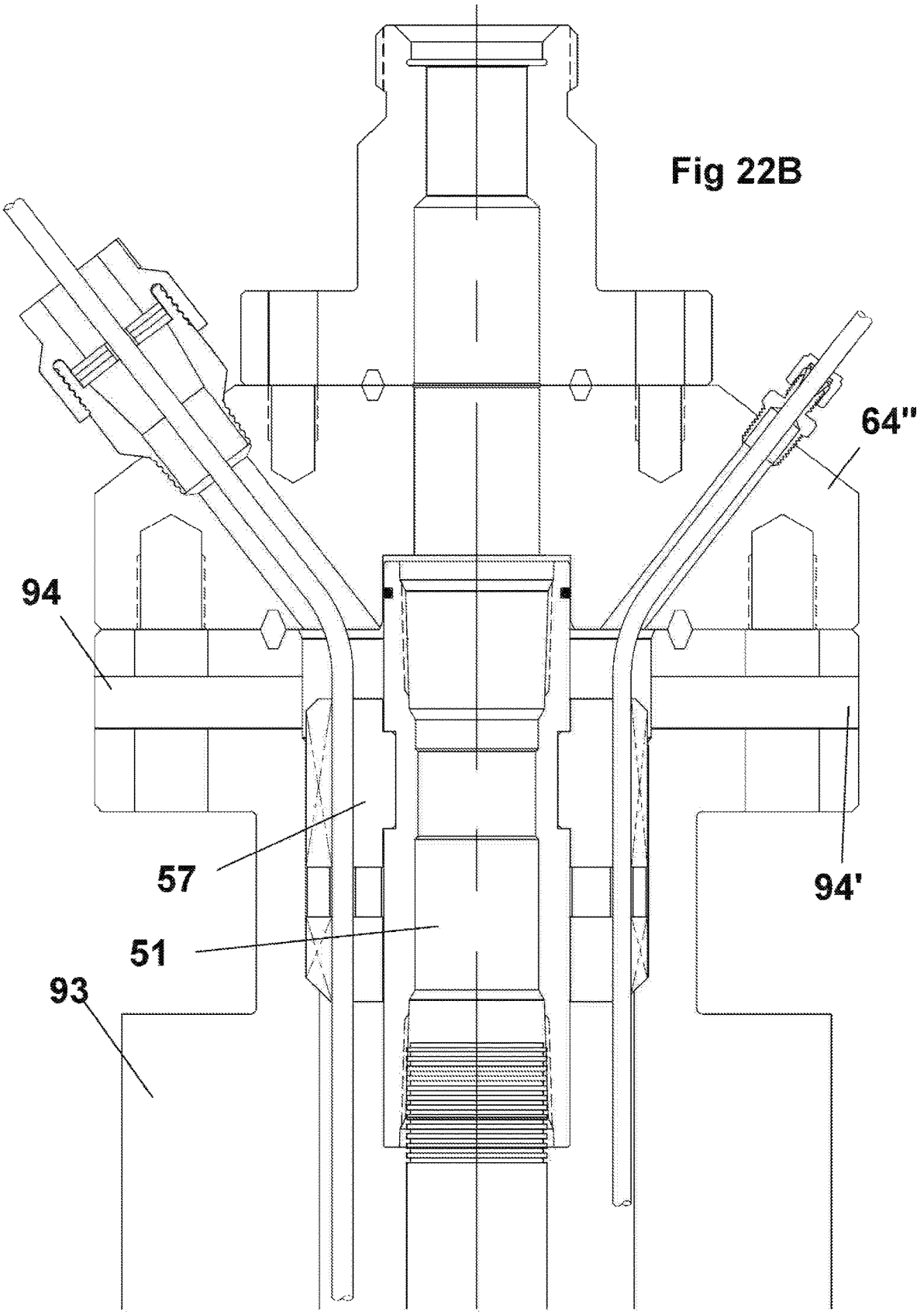
FIG. 22B is a side, partially cross-sectional, partially cut-away view of the invention of FIG. 22 mounted to the flange of a conventional tubing spool, illustrating a tubing adapter cap 64" having a top flange mount, and first 94 and second 94' locking pin passage to lock the hanger 57 in the bowl, about completion coupling 51.
Figure 23A:
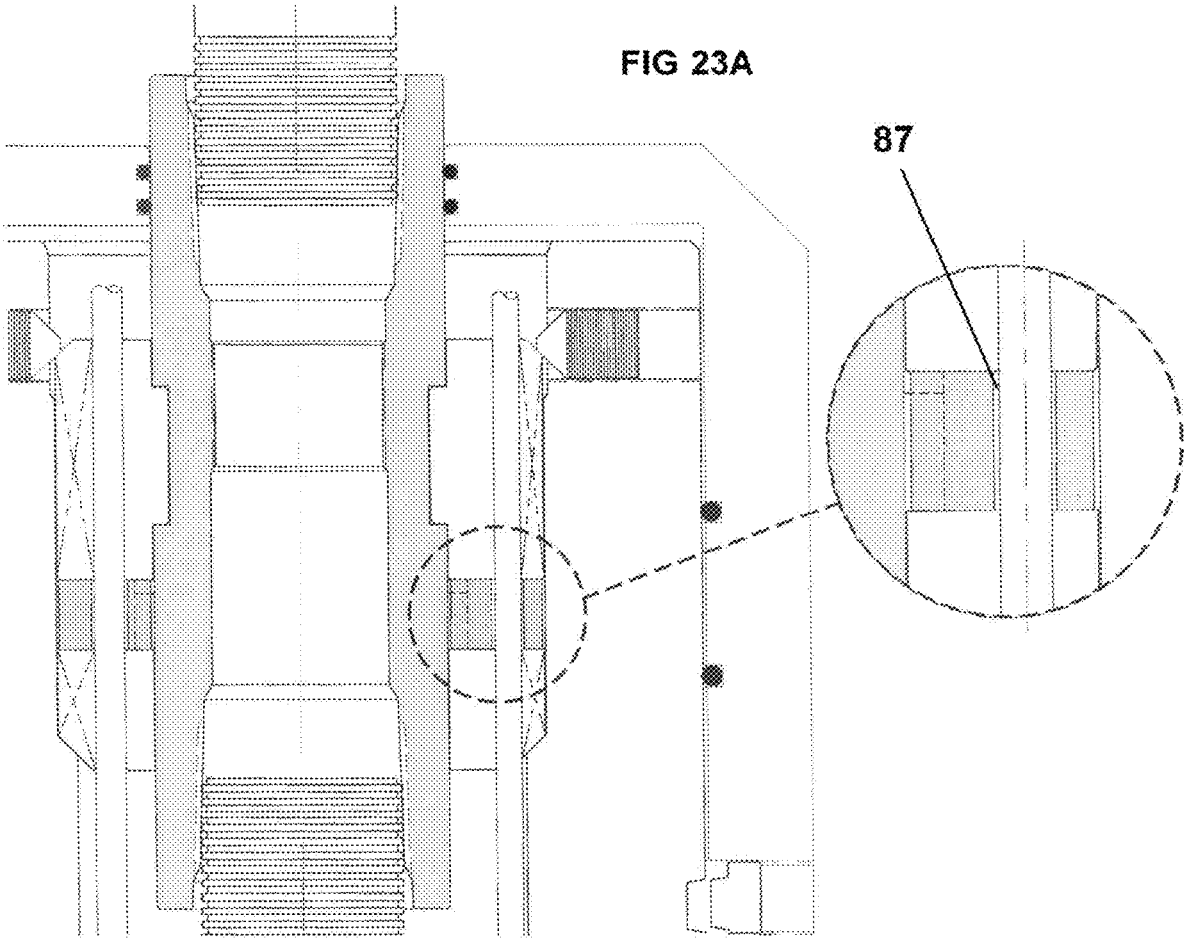
FIG. 23A is a side, partially cut-away view of the invention of FIG. 14, illustrating the hanger in the bowl but without the weight of the coupling, and the main seal 61 in an un-compressed state, and the tolerance or space 87 between the main seal and the components threaded therethrough, the completion coupling, and the bowl.
Figure 23B:
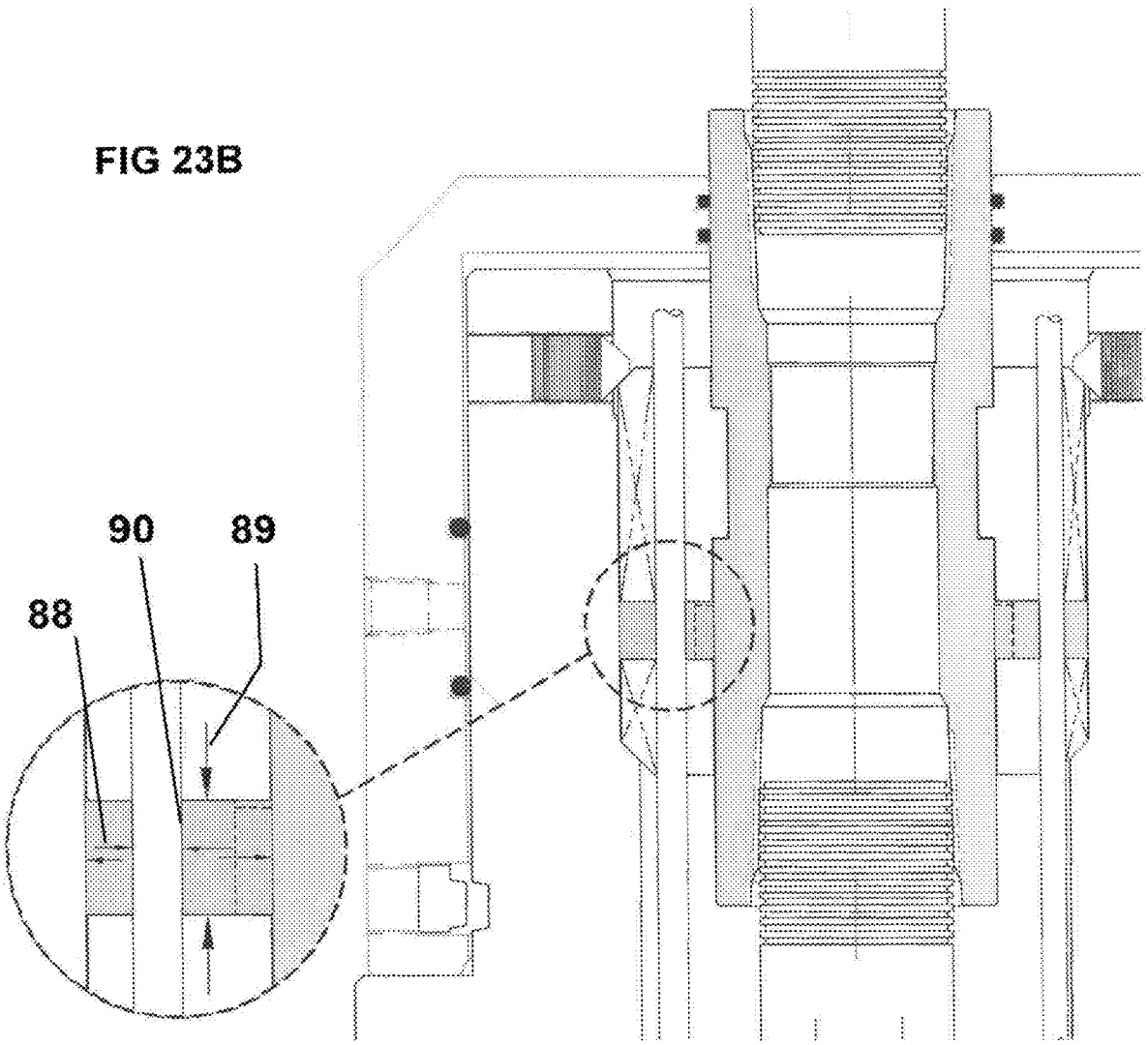
FIG. 23B is a side, partially cut-away view of the invention of FIG. 23A, but with the weight of the tubing string supported by the bowl via the hanger and completion coupling, illustrating the seal 61 compressed 88 by the weight 89 of the string to engage 90 and seal the components, completion coupling and bowl, sealing the well.

FIG. 20 illustrates alternative insert and spacer profiles which could be suitable for use depending on the profile of the component involved.

ELEMENTS OF THE INVENTION

1 wrap-around Hanger
2 Tubing
3 Collar
4 Power Cable (ESP Conduit)
5 Wellhead
6 tubing head
7 bowl
8 ESP Pump
9 Casing
10 capillary line
11,' protective jacket, insulated wires
12 hinged
13,' first, second hanger sections
14,' upper, lower hanger body
15 seal
16 pin
17,' hinge buckles
18,' bolt
19 OD
20 ID
21 receiver
22,' gripping profiles
23 pivot
24,' open, closed
25,' bolts
26,' first and second side doors or gates
27,' upper, lower ESP power cable door sections
28,' upper, lower control line door sections
29,' bolt
30 component slot—first side door
31 component slot—second side door
32,' bolt passages
33,' main seal passage
34,' inner gripping profile inserts
35,' inserts
latch bolt
37,' closed
tubing string lowered
39,' hold down pins
40,' positioned
41,' slits
42-49 n/a
50 second embodiment
51 completion coupling
52 tubing
53 handling pup
54 special modular tubing head
55 neck
56 tubing head bowl
57 wrap around hanger
58 ID of hanger
59 ridge hanger
60 completion coupling slot
61 main seal
62,' first, second side doors
63,' locking bolts
64 bowl cap
64' flanged top bowl cap
64" conventional tubing spool flanged wellhead cap
65 groove at the base of the neck
66 slip over
67, metal spacer
68 elastomeric/rubber seal
69 threaded compression cap
70 profile
71 component width
72,' first, second compression fittings
73,' height, ID
74 top
75 first, second apertures
76 housing
77 conical insert/wedge-lock seal
78 threaded area
79,' first, second ends
80 inner walls
81 taper
82 into
83 frustoconical form
84 gasket
85 threads
86 bolts
87 space
88 engage
89 weight, compress
90 seal
91,',",'" main seal compression limiters
92 flanged component
93 conventional wellhead
94,' locking pin passage
95 compression limiter passage The present invention therefore teaches, among other things, an apparatus and method of sealing a wellhead having a component emanating therefrom, the method comprising the steps of:

a) providing a hanger having a main seal;

b) mounting said hanger to a tubing string;

c) threading said component through a passage formed in said main seal;

d) using said hanger to support the weight of a tubing string in said wellhead to compress said main seal, providing a compressed main seal; and e) utilizing said compressed main seal to seal said wellhead.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A tubing hanger for sealing a wellhead, comprising:

a slot formed to receive a component, a gripper formed to grip said component in said slot, a hanger seal having a component passage formed therethrough in alignment with said slot, whereby, upon mounting said hanger to a tubing string associated with said wellhead and threading a component through said component passage and said slot, and engaging said gripper to said component to retain said component, then positioning said tubing hanger to support the weight of said tubing string, said tubing hanger with tubing string compressing said hanger seal to swell said hanger seal, sealing said wellhead while providing sealed passage of said component therethrough.

2. The apparatus of claim 1, wherein said gripper comprises a side door having a raised area positioned to grip said first component upon closing said side door over said first slot.

3. The apparatus of claim 2, wherein said raised area of said side door has a profile shaped to engage said component.

4. The apparatus of claim 3, wherein said component profile is formed on the side of said door facing said slot.

5. The apparatus of claim 4, wherein said component profile comprises an insert situated in said slot.

6. The apparatus of claim 5, wherein the component comprises an electric submersible pump power line.

7. The apparatus of claim 6, wherein said hanger seal has formed therein a second component passage for the passage of a second component therethrough.

8. The apparatus of claim 7, wherein there is provided a second gripper associated with said hanger to engage said second component.

9. The apparatus of claim 8, wherein said second component comprises a control line.

10. The apparatus of claim 6, wherein said hanger is formed to engage tubing.

11. The apparatus of claim 6, wherein said hanger is formed to engage a completion coupling affixed to said tubing string.

12. The apparatus of claim 11, wherein said wellhead comprises a tubing head having a bowl.

13. The apparatus of claim 12, wherein there is further provided a bowl cap formed to engage said tubing head, said bowl cap having a compression seal formed to receive said component therethrough.

14. The apparatus of claim 13, wherein said compression seal comprises a housing with split frustoconical insert formed to compress around and seal about said component as said insert is urged into said housing.

15. The apparatus of claim 14, wherein said compression seal further comprises first and second split washers having a profile configured to sealingly engage said component, and a cap formed to urge said frustoconical insert into said housing via said split washers.

16. The apparatus of claim 15, wherein said bowl cap further comprises a second compression seal for said second component.

17. The apparatus of claim 5, wherein said component comprises an electrical line, fluid conduit, rod or support cable.

18. The apparatus of claim 5, wherein said component comprises a length of flexible material emanating from said wellhead.

19. The apparatus of claim 1, wherein there is further provided first and second compression limiters which are situated in passages formed in said hanger seal to selectively limit the compression of said hanger seal, while optimizing sealing action of said hanger seal against said component.

20. A hanger for sealing a wellhead having tubing and a component emanating therefrom, comprising:

a hanger seal formed to allow the passage of said component therethrough;

a gripper formed to engage and grip said component;

whereby, upon passing said component through said hanger seal, engaging said gripper to retain said component, and utilizing said hanger to support said tubing in a bowl, said hanger seal compresses to seal said component, tubing, and bowl to seal said wellhead.

21. The apparatus of claim 20, wherein said gripper comprises a side door having a raised gripping area positioned to grip said first component upon closing said side door over said first slot.

22. The apparatus of claim 21, wherein said raised gripping area of said side door comprises a profile shaped to engage said component.

23. The apparatus of claim 22, wherein said component profile is formed on the side of said door facing said slot.

24. The apparatus of claim 23, wherein said hanger seal has formed therein a second component passage for the passage of a second component therethrough.

25. The apparatus of claim 24, wherein there is provided a second gripper associated with said hanger to engage said second component.

26. The apparatus of claim 25, wherein said second component comprises a capillary line.

27. The apparatus of claim 20, wherein said component profile comprises an insert situated in said slot, and a side door formed to close over said slot so as to urge said component against said insert.

28. The apparatus of claim 20, wherein the component comprises an electric submersible pump power line.

29. The method of sealing a wellhead having a component emanating therefrom, comprising the steps of:

a) providing a hanger having a hanger seal;

b) threading said component through a passage formed in said hanger seal;

c) using said hanger to support the weight of a tubing string in said wellhead to compress said hanger seal, providing a compressed hanger seal d) utilizing said compressed hanger seal to seal said component at said hanger seal.

30. The method of claim 29, wherein after step "b" there is provided the added step "b1" of mounting said hanger to a tubing string, and after step "d" there is provided the step "d1" of utilizing said compressed hanger seal to seal said wellhead.

31. The method of claim 30, wherein there is provided after step "b1" the added step "b2" of positioning said hanger to a bowl, and after step "d1" of utilizing said compressed hanger seal to seal said bowl.

32. The method of claim 30, wherein after step "b" there is provided the added step "b1" the step of mounting said hanger to a completion coupling engaged to a tubing string, and after step "d" there is provided the step "d1" of utilizing said compressed hanger seal to seal said completion coupling.

33. The method of claim 32, wherein there is provided after step "b1" the added step "b2" of positioning said hanger to a bowl, and after step "d1" of utilizing said compressed hanger seal to seal said bowl.

34. The method of claim 33, wherein there is provided after step wherein there is provided after step "d1" the added step "e" of securing a bowl cap over said bowl.

35. The method of claim 34, wherein step "e" comprises the added sub-step "e1" of threading a length of said component through a compression fitting mounted to said bowl cap, and engaging said compression fitting to form a seal about said component.

36. The method of claim 35, wherein step "e1" said compression fitting comprises a housing, split insert and fitting cap, and wherein there further comprises the sub-step "e2" of mounting said housing to said bowl cap, passing a length of said component through said compression fitting, and tightening said fitting cap so as to urge said insert into said housing, so as to compress said insert against said housing and said component, forming a seal.

37. The method of claim 32, wherein in step "c" there is further provided the added step of allowing said compression limiters to limit the compression of said hanger seal to facilitate sealing of said wellhead.

38. The method of claim 29, wherein there is further provided after step "a" the additional steps of:

i. utilizing the compression characteristics of said hanger seal, and utilizing the estimated weight of a tubing string in said wellhead to determine the appropriate compression for said hanger seal to seal said wellhead;

ii. adjusting the compression of said hanger seal by placing compression limiters in said hanger seal.

* * * * *